US012698621B2

(12) United States Patent
Zelkovich

(10) Patent No.: US 12,698,621 B2
(45) Date of Patent: Aug. 4, 2026

(54) REINFORCED WEAR MEMBER

(71) Applicant: Hensley Industries, Inc., Dallas, TX (US)

(72) Inventor: Evan M. Zelkovich, Heartland, TX (US)

(73) Assignee: Hensley Industries, Inc., Dallas, TX (US)

( * ) Notice: Subject to any disclaimer, the term of this patent is extended or adjusted under 35 U.S.C. 154(b) by 619 days.

(21) Appl. No.: 18/187,536

(22) Filed: Mar. 21, 2023

(65) Prior Publication Data

US 2023/0332383 A1 Oct. 19, 2023

Related U.S. Application Data

(60) Provisional application No. 63/330,424, filed on Apr. 13, 2022.

(51) Int. Cl.
*E02F 9/28* (2006.01)

(52) U.S. Cl.
CPC ..... *E02F 9/285* (2013.01); *E02F 9/2858* (2013.01); *E02F 9/2883* (2013.01)

(58) Field of Classification Search
CPC ..... E02F 9/2883; E02F 9/285; E02F 9/2858; C22C 1/1036; C22C 1/1021; B22D 19/14; B22D 19/02
See application file for complete search history.

(56) References Cited

U.S. PATENT DOCUMENTS 3,984,910 A * 10/1976 Helton ..... E02F 9/285 419/48
4,101,318 A 7/1978 Rudy
4,488,608 A * 12/1984 Berchem ..... B28D 1/188 175/426
5,043,182 A 8/1991 Schultze
(Continued)

FOREIGN PATENT DOCUMENTS

JP S56138963 U 10/1981
JP H03265584 A 11/1991
(Continued)

OTHER PUBLICATIONS

International Searching Authority, International Search Report and Written Opinion of the International Searching Authority, International Application No. PCT/US23/17321, Jun. 3, 2023, 10 pages.
(Continued)

*Primary Examiner* — Christopher J Sebesta
*Assistant Examiner* — Blake E Scoville
(74) *Attorney, Agent, or Firm* — Haynes and Boone, LLP

(57) ABSTRACT

A reinforced wear member for use in earth-engaging applications. The wear member may have a body with an embedded core. The body may have a leading end and an opposing trailing end. The core may have a front end and an opposing back end wherein a height of the front end is less than a height of the back end. The body may be comprised of a first composition and the core may be comprised of a second composition that is different from the first composition. The first composition may be steel and the second composition may be ceramic. The ceramic core may increase the abrasive resistance of the wear member.

20 Claims, 22 Drawing Sheets

(56) References Cited

U.S. PATENT DOCUMENTS

| | | | | |
|---|---|---|---|---|
| 5,066,546 | A * | 11/1991 | Materkowski | E02F 9/285 428/614 |
| 5,081,774 | A * | 1/1992 | Kuwano | E02F 9/285 428/614 |
| 5,154,984 | A | 10/1992 | Morita | |
| 5,223,195 | A | 6/1993 | Kuwabara | |
| 5,360,662 | A | 11/1994 | Wong | |
| 5,375,350 | A * | 12/1994 | Maybon | B22F 7/08 37/453 |
| 5,503,122 | A | 4/1996 | Ritland | |
| 5,511,603 | A | 4/1996 | Brown | |
| 5,525,374 | A | 6/1996 | Ritland | |
| 5,702,542 | A | 12/1997 | Brown | |
| 6,112,635 | A | 9/2000 | Cohen | |
| 6,338,906 | B1 | 1/2002 | Ritland | |
| 6,399,018 | B1 | 6/2002 | German | |
| 6,527,092 | B2 | 3/2003 | Gruber | |
| 6,723,279 | B1 | 4/2004 | Withers | |
| 7,267,882 | B2 | 9/2007 | Breslin | |
| 7,290,586 | B2 | 11/2007 | Sambrook | |
| 7,357,976 | B2 | 4/2008 | Yamamura | |
| 7,461,684 | B2 | 12/2008 | Liu | |
| 7,820,299 | B2 | 10/2010 | Andreussi | |
| 8,147,980 | B2 | 4/2012 | Bhide | |
| 8,485,336 | B2 | 7/2013 | Tenold | |
| 8,499,818 | B2 | 8/2013 | Grozdanich | |
| 8,646,192 | B2 * | 2/2014 | Berton | E02F 9/28 37/460 |
| 8,763,282 | B2 * | 7/2014 | Brufau Guinovart | C22C 33/0242 37/460 |
| 8,795,828 | B2 | 8/2014 | Grozdanich | |
| 8,806,785 | B2 | 8/2014 | Brufau Guinovart | |
| 8,960,262 | B2 | 2/2015 | Grozdanich | |
| 8,967,230 | B2 | 3/2015 | Grozdanich | |
| 8,985,185 | B2 | 3/2015 | Tenold | |
| 9,186,723 | B2 | 11/2015 | Adams | |
| 9,212,413 | B2 | 12/2015 | Wang | |
| 9,429,202 | B2 | 8/2016 | Moore | |
| 9,714,686 | B2 | 7/2017 | Moore | |
| 9,764,987 | B2 | 9/2017 | Hill | |
| 9,840,030 | B2 | 12/2017 | Moore | |
| 10,081,055 | B2 | 9/2018 | Miyakawa | |
| 10,233,125 | B2 | 3/2019 | Goto | |
| 10,529,591 | B2 | 1/2020 | Miyakawa | |
| 10,830,296 | B2 | 11/2020 | Moore | |
| 10,865,465 | B2 | 12/2020 | Sherman | |
| 2004/0151935 | A1 | 8/2004 | Dzugan | |
| 2004/0202883 | A1 | 10/2004 | Scheydecker | |
| 2007/0009754 | A1 | 1/2007 | Dzugan | |
| 2009/0197074 | A1 | 8/2009 | Fujita | |
| 2010/0009163 | A1 | 1/2010 | Lindemann | |
| 2010/0247840 | A1 | 9/2010 | Mitchick | |
| 2011/0225856 | A1 * | 9/2011 | Berton | E02F 9/28 164/58.1 |
| 2012/0186919 | A1 | 7/2012 | Hanna | |
| 2012/0240755 | A1 | 9/2012 | Tenold | |
| 2012/0244344 | A1 | 9/2012 | Tenold | |
| 2013/0081776 | A1 | 4/2013 | Hanna | |
| 2015/0158082 | A1 | 6/2015 | Tenold | |
| 2015/0190864 | A1 | 7/2015 | Tenold | |
| 2017/0225225 | A1 | 8/2017 | Sarkisian | |
| 2018/0306260 | A1 | 10/2018 | Moore | |
| 2019/0032173 | A1 | 1/2019 | Sherman | |
| 2019/0169822 | A1 | 6/2019 | Montross | |
| 2019/0337856 | A1 | 11/2019 | Liu | |
| 2020/0385842 | A1 | 12/2020 | Sherman | |
| 2020/0399185 | A1 | 12/2020 | Ishiguro | |
| 2020/0407822 | A1 | 12/2020 | Sherman | |
| 2021/0131076 | A1 * | 5/2021 | Berton | B22F 3/23 |

FOREIGN PATENT DOCUMENTS

| | | | | |
|---|---|---|---|---|
| JP | H0754381 | A | 2/1995 | |
| JP | H07138087 | A | 5/1995 | |
| JP | 11131534 | A * | 5/1999 | |
| JP | H11131534 | A2 | 5/1999 | |
| KR | 20140145699 | A | 12/2014 | |
| WO | WO-0076666 | A1 * | 12/2000 | B22D 19/06 |
| WO | 2008071184 | A2 | 6/2008 | |
| WO | WO-2010031660 | A1 * | 3/2010 | C22C 33/0242 |
| WO | 2019107541 | A1 | 6/2019 | |
| WO | 2019211583 | A1 | 11/2019 | |
| WO | 2020013300 | A1 | 1/2020 | |
| WO | WO-2021205968 | A1 * | 10/2021 | E02F 9/2858 |

OTHER PUBLICATIONS

Extended European Search Report mailed Mar. 18, 2026 in related European application No. 23788761, 10 pages.

* cited by examiner

REINFORCED WEAR MEMBER

PRIORITY

This disclosure claims priority to and the benefit of the filing date of U.S. Provisional Patent Application No. 63/330,424, filed Apr. 13, 2022, titled Reinforced Wear Member, incorporated herein by reference in its entirety.

TECHNICAL FIELD

This disclosure is generally directed to an earth-engaging wear member assembly including a reinforced wear member which is attachable to a support structure. More particularly, this disclosure is directed to a wear member comprising a steel body reinforced with a wear resistant core.

BACKGROUND

Material displacement apparatuses, such as excavating buckets found on construction, mining, and other earth moving equipment, often include replaceable wear portions such as earth engaging wear member assembly. These are often removably carried by larger base structures, such as excavating buckets, and come into abrasive, wearing contact with the earth or other material being displaced. For example, excavating wear member assemblies provided on digging equipment, such as excavating buckets and the like, typically comprise a relatively massive support structure portion which is suitably anchored to the forward bucket lip. The support structure portion typically includes a reduced cross-section, forwardly projecting wear member or nose. A replaceable wear member typically includes an opening that releasably receives the nose of the support structure.

Wear members are generally made of steel. Although steel lends the wear member high impact resistance, many applications for earth engaging wear member assemblies require the wear members have high abrasive resistance as well. For this reason, a number of different types of wear members use ceramic to add abrasive resistance. In some types of wear members, steel surrounds a ceramic core. However, the shape, materials, and manufacturing of current ceramic cores do not optimize abrasive and impact resistance of the wear member. A need accordingly exists for an improved wear member with a steel body reinforced with a ceramic core.

SUMMARY

Some embodiments of the present disclosure include a reinforced wear member comprising a body having a leading end and a trailing end and a core embedded within the body and having a front end and an opposing back end, where the height of the front end is shorter than the height of the back end. In this embodiment, the body has a first composition, and the core has a second composition different from the first composition. In some embodiments, the first composition is steel, and the second composition is ceramic. The core may be entirely embedded within the body or may be partially embedded within the body such that a portion of an outer surface of the core is exposed.

In some embodiments, the core may be wedge-shaped. The front end of the core may come to a point. In some embodiments, the wedge-shaped core may comprise an upper core surface aligning with an upper body surface at an angle in the range of 0 degrees to 8 degrees and a lower core surface opposing the upper core surface and aligning with a lower body surface opposing the upper core surface at an angle in the range of 0 degrees to 8 degrees. The core may be disposed adjacent the leading end, adjacent the trailing end, or somewhere in between.

In some embodiments of the present disclosure, the core may comprise a mainstay and girders extending from the mainstay. The mainstay may be at the front end or at the back end. The core may have any number of girders. For example, the core may have three girders. In some embodiments, the core may be monolithic.

In some embodiments, the core may be a ceramic such as silicon carbide, zirconia-yttria, zirconia-magnesia, zirconia-calcia, zirconia-alumina, white alumina, tabular alumina, aluminate spinel, mullite, tungsten carbide or titanium carbide. The core may have a volumetric porosity ranging from 45% to 95%.

In another embodiment of the present invention, the wear member may comprise a steel body having a leading end and a trailing end, and a wedge-shaped ceramic core embedded within the steel body. The core may be disposed along a longitudinal axis of the body. In some embodiments, the core may have an upper core surface and an opposing lower core surface generally aligned with an outer upper body surface and an opposing lower body surface of the steel body, respectively. In some embodiments, the upper core surface may not be generally aligned with an upper body surface. In other embodiments, the lower core surface may not be generally aligned with a lower body surface. Moreover, one or more surfaces of the core may be curved.

Another embodiment of the present disclosure may be a method of manufacturing a reinforced wear member. The method may comprise the step of providing a mold comprising one or more parts, wherein the mold has a cavity in the shape of a wear member for attachment to excavating equipment. The method may also include the step of placing one or more restraints at the top of the mold. The method may also include placing an abrasive resistant core in the mold below the one or more restraints. The core may have a front end and an opposing back end such that a height of the front end is less than a height of the back end. The method may also comprise the step of filling the mold with liquefied steel such that the core rises upward to contact the one or more restraints. The steel may be less abrasive resistant than the core.

In some embodiments, the core may be ceramic. In some embodiments, the restraints may be chaplets. The chaplets may be comprised of steel. In another embodiment, a second set of restraints may be placed at the bottom of the mold. The core may rise upward to contact the one or more restraints when the mold is filled with liquefied steel. The method may also comprise the step of cooling the steel such that an air gap forms between the steel and the core. This process may be used to manufacture a core as described in the present disclosure.

It is to be understood that both the foregoing general description and the following drawings and detailed description are exemplary and explanatory in nature and are intended to provide an understanding of the present disclosure without limiting the scope of the present disclosure. In that regard, additional aspects, features, and advantages of the present disclosure will be apparent to one skilled in the art from the following. One or more features of any embodiment or aspect may be combinable with one or more features of other embodiment or aspect.

BRIEF DESCRIPTION OF THE DRAWINGS

The accompanying drawings illustrate implementations of the systems, devices, and methods disclosed herein and together with the description, serve to explain the principles of the present disclosure.

Figure 1A:
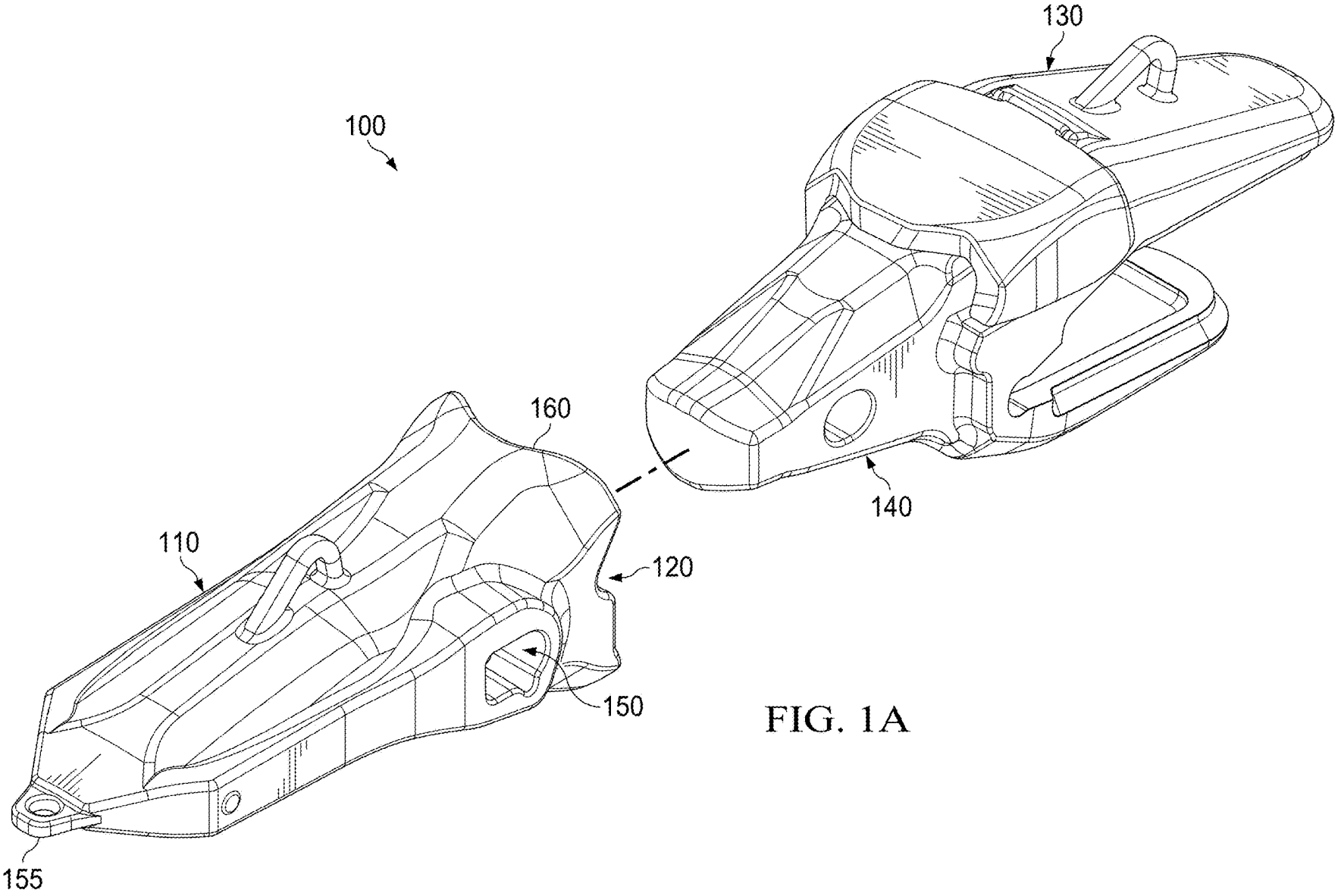
FIG. 1A is an exploded view of an earth engaging wear member assembly according to an example incorporating principles described herein.

These Figures will be better understood by reference to the following Detailed Description.

DETAILED DESCRIPTION

For the purposes of promoting an understanding of the principles of the present disclosure, reference will now be made to the implementations illustrated in the drawings and specific language will be used to describe them. It will nevertheless be understood that no limitation of the scope of the disclosure is intended. Any alterations and further modifications to the described devices, instruments, methods, and any further application of the principles of the present disclosure are fully contemplated as would normally occur to one skilled in the art to which the disclosure relates. In addition, this disclosure describes some elements or features in detail with respect to one or more implementations or Figures, when those same elements or features appear in subsequent Figures, without such a high level of detail. It is fully contemplated that the features, components, and/or steps described with respect to one or more implementations or Figures may be combined with the features, components, and/or steps described with respect to other implementations or Figures of the present disclosure. For simplicity, in some instances the same or similar reference numbers are used throughout the drawings to refer to the same or like parts.

The present disclosure is directed to a reinforced wear member usable in a variety of earth engaging applications. In some embodiments, the wear member is part of an earth-engaging wear member assembly for use on the bucket lip of an excavator. In these embodiments, the wear member assembly may include a wear member, such as a tooth, adapter, or intermediate adapter, that is attachable to a support structure, such as an adapter, an intermediate adapter, a nose on a lip or a base structure. For example, the wear member assembly may be a tooth attached over the nose of an adapter or may be an adapter attached over the nose of a lip. In some implementations, the wear member may include a rear facing cavity designed to fit over a projection or nose on the support structure. However, in other embodiments, the wear member may have a projection that fits into a cavity on the support structure to hold the wear member to the support structure. In some embodiments, the wear member and nose of the support structure can be secured via a locking member.

Figure 1B:
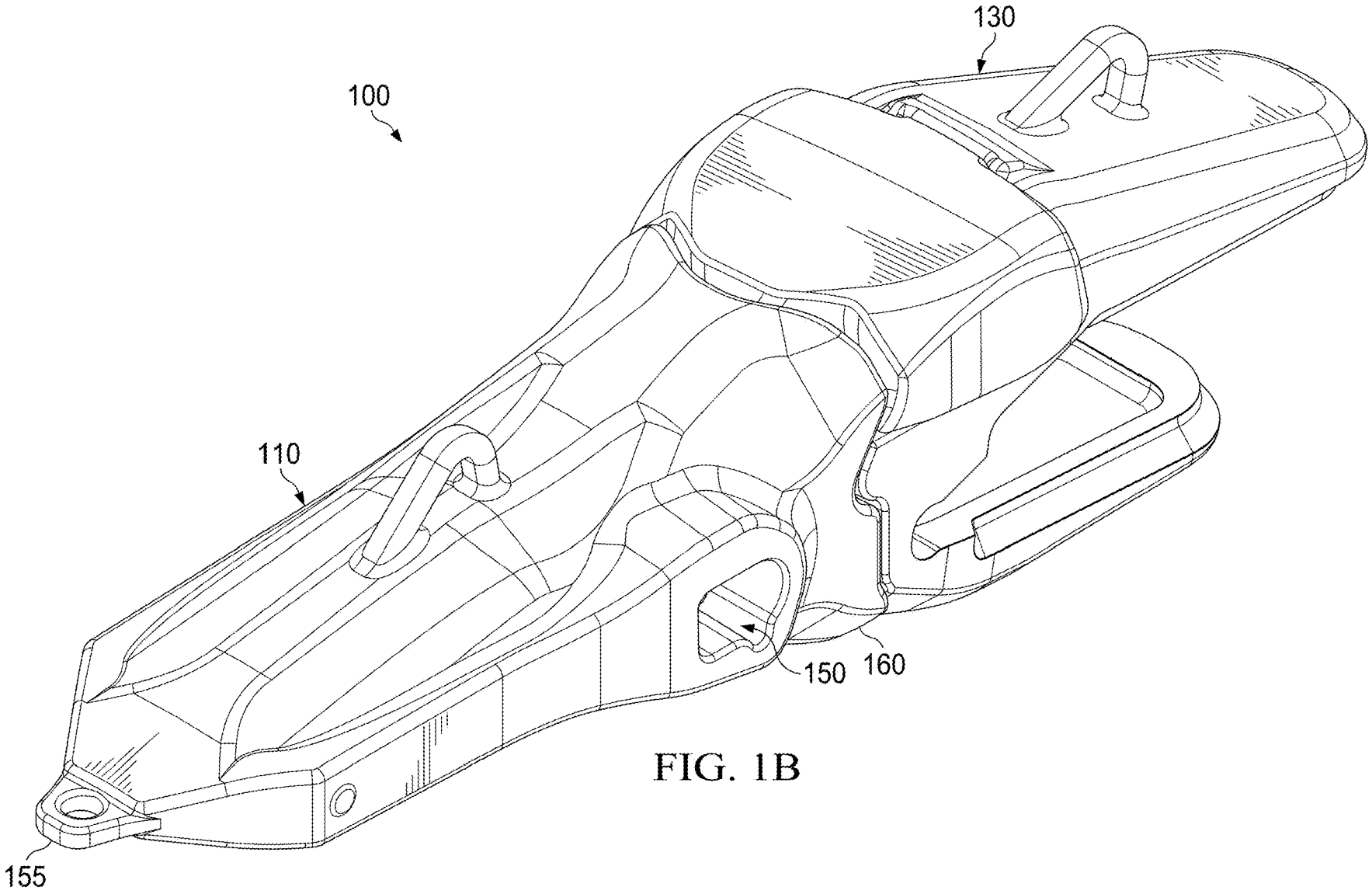
FIG. 1B is a view of an assembled earth engaging wear member assembly according to an example incorporating principles described herein.

FIGS. 1A-1B show an exemplary earth engaging wear member assembly 100 according to one example of the present disclosure, without the bucket lip. FIG. 1A shows an exploded view of the wear member assembly 100. In the present example shown, the earth engaging wear member assembly 100 includes a wear member 110, a support structure 130, and a locking member (not shown). The wear member 110 includes an opening 150 configured to receive the locking member to secure the wear member 110 to the support structure 130 in a conventional manner. As indicated above, the earth engaging wear member assembly may include the wear member 110, a support structure 130, and the locking member 150. In this particular embodiment, the wear member 110 includes a leading end 155, a trailing end 160, and a cavity 120 in the trailing end 160. The support structure 130 includes a projection 140 that may be referenced as a nose. FIG. 1B shows the wear member 110 and the support structure 130 secured by the locking member 150. The cavity 120 of the wear member 110 may fit over the projection 140 of the support structure 130. The locking member 150 secures the wear member 110 and the support structure 130. The locking member 150 may be any suitable mechanism for securing the wear member 110 to the support structure 130, including but not limited to a locking pin a screw, or other interference member.

As described in detail below, the wear member 110 includes a core embedded within a body to increase abrasion resistance while still maintaining impact resistance during use. The core is shaped such that a height of the front end of the core is shorter than a height of the back end. Thus, the core changes in geometry between the front end and the back end.

The core is a different composition than the body, and therefore provides different wear characteristics than the body alone. In some embodiments, the core is ceramic and the body is steel. In some embodiments, the ceramic core is formed as an open cell, porous, ceramic matrix that allows molten steel to flow into, around, and through the porous matrix, around the fibrils defining the pores of the matrix. In some example embodiments, the ceramic core may have a volumetric porosity in the range of 45% to 95%. Other volumetric porosity ranges are contemplated. In a particular embodiment, the ceramic core may have a volumetric porosity of 75-85%, and in yet other embodiments, the volumetric porosity may be in a range of about 70-90%. The molten steel may harden as it solidifies in and about the tendrils making up the matrix. However, in other embodiments, the ceramic core may not be porous. In some embodiments, the core is entirely embedded under the outer surface of the wear member so as to not be visible from the outside. In this embodiment, during use, the softer, more ductile metal may wear away exposing the higher abrasion-resistant ceramic core. In embodiments where the steel is embedded in and through the ceramic core, the resulting wear member may have increased abrasion resistance while still maintaining suitable impact resistance for typical operations. In other embodiments, the core is partially embedded such that at least a portion of the surface of the core is exposed or not covered by the body. In some embodiments, the core may be surrounded by another material or may be coated.

Figure 2A:
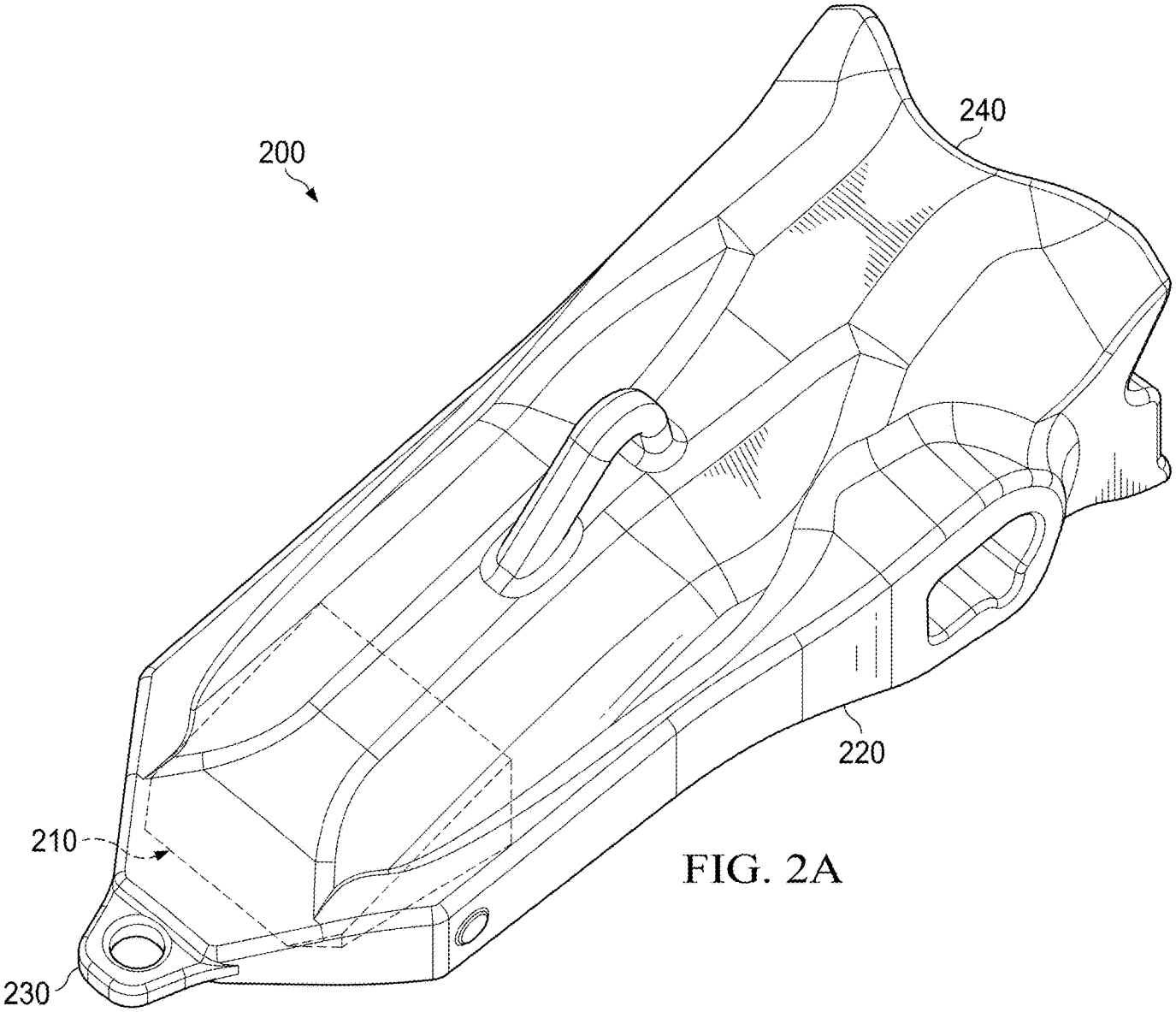
FIG. 2A is a perspective view of a wear member according to an example incorporating principles described herein.

FIGS. 2A-2D shows one embodiment of a wear member 200 according to the current disclosure. FIG. 2A shows a perspective view of the wear member 200. The wear member 200 has a leading end 230 and a trailing end 240. The wear member 200 includes a ceramic core 210 (shown in dashed lines) and a steel body 220 that surrounds the ceramic core 210. The steel body 220 and the ceramic core 210 are wedge-shaped. The ceramic core 210 has a front end 250 and an opposing back end 260. The ceramic core 210 is positioned towards the leading end 230 of the steel body 220 such that the front end 250 is proximate to the leading end 230 of the steel body 220.

Figure 2B:
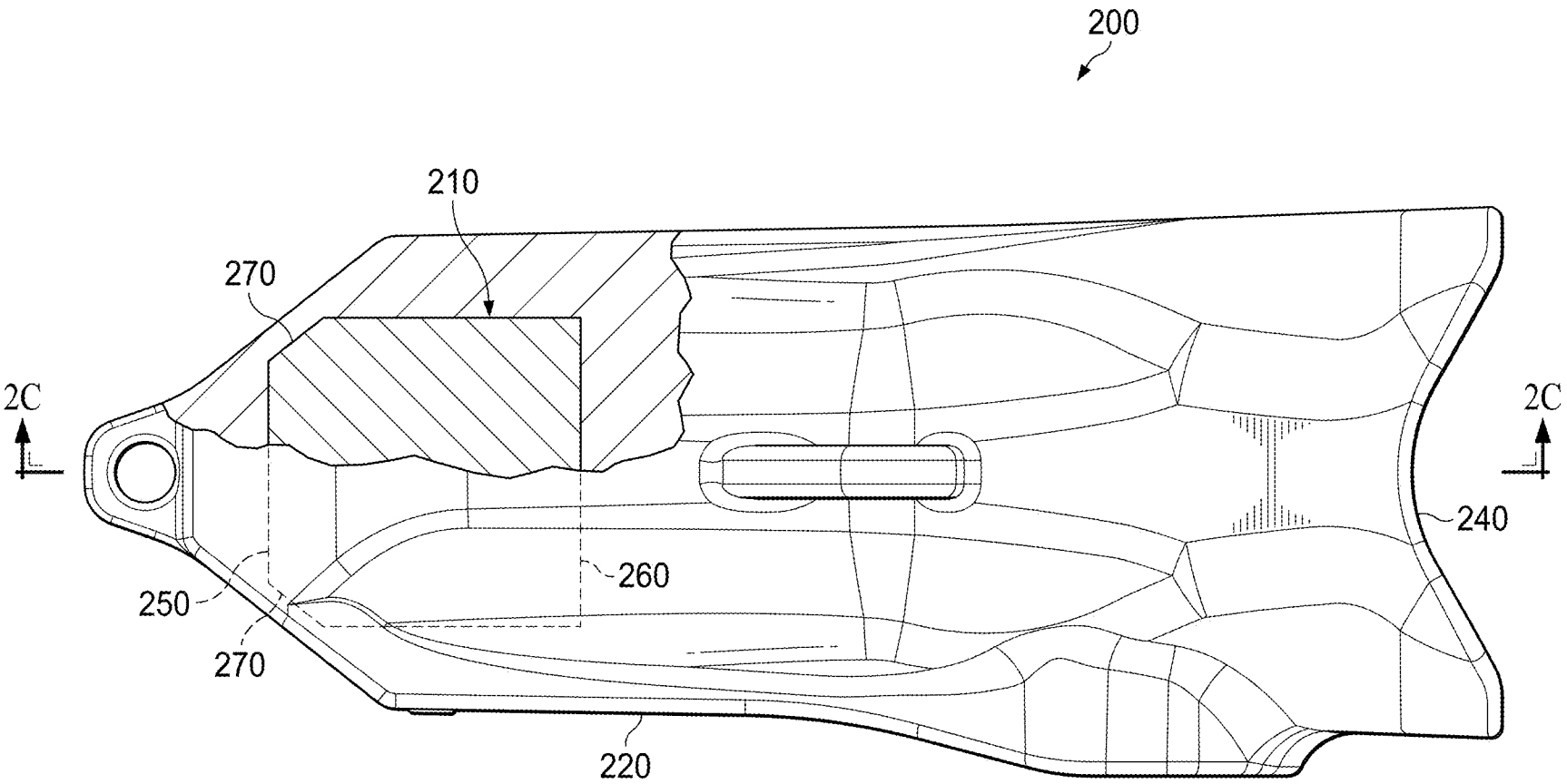
FIG. 2B is a partial cut away top view of the wear member shown in FIG. 2A.

FIG. 2B illustrates a partial cut-away top view of wear member 200. In the present embodiment, the top profile of the ceramic core 210 is approximately rectangularly shaped, with corners 270 that are angled on each side of the front end 250 of the ceramic core 210. In another embodiment, the corners 270 may be pointed, rounded, or another shape.

Figure 2C:
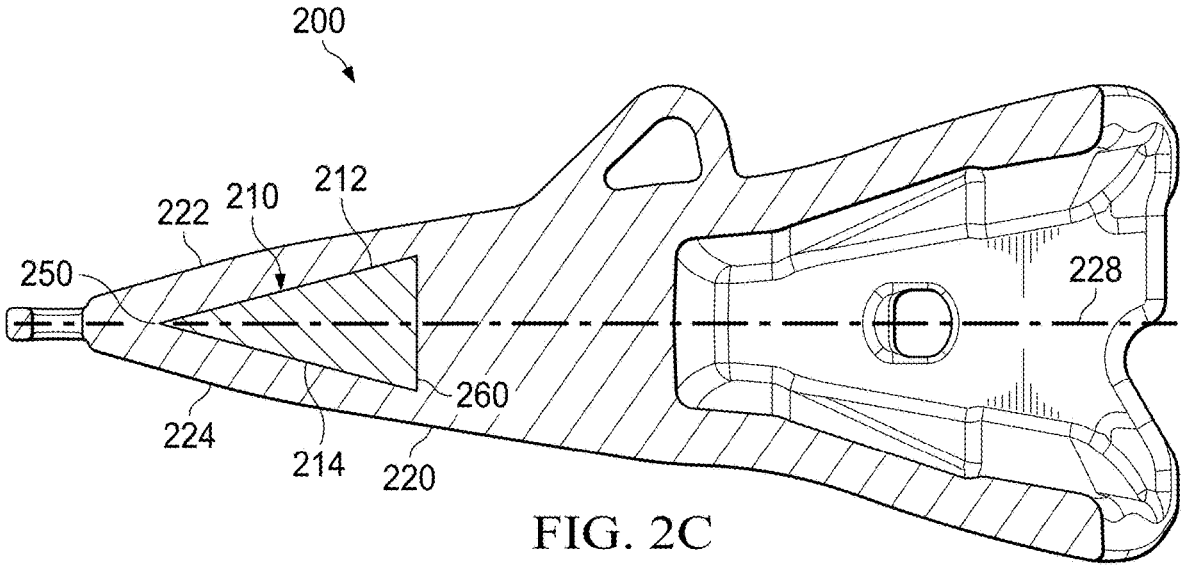
FIG. 2C is a side view of the wear member shown in FIG. 2A.

FIG. 2C shows a side view of the wear member 200. The steel body 220 has an upper body surface 222 and an opposing lower body surface 224. The ceramic core 210 has an upper core surface 212 and an opposing lower core surface 214. The ceramic core 210 is shaped such that the upper core surface 212 and the lower core surface 214 generally follow the trend of the upper body surface 222 and the lower body surface 224, respectively. That is, the upper core surface 212 and the lower core surface 214 diverge in a manner generally similar to the upper body surface 222 and an opposing lower body surface 224. In some implementations, the upper core surface 212 and the lower core surface 214 diverge in a manner generally similar to the upper body surface 222 and an opposing lower body surface 224 when the angle between the respective core surfaces and the body surfaces diverge by an angle of about 0 to 15 degrees.

In the present embodiment, the ceramic core 210 is shaped such that the upper core surface 212 is generally aligned with the upper body surface 222 and the lower core surface 214 is generally aligned with the lower body surface 224 when placed within the steel body 220. In some implementations, the angle between the core surfaces 212, 214 and the body surfaces 222, 224 may diverge by an angle of about 0 to 8 degrees. Therefore, the wedge shape of the ceramic core 210 matches the wedge shape of the steel body 220. Because the ceramic core 210 matches the shape of the steel body 220, the ceramic core may help the steel body resist abrasive wear. Therefore, the wear member of the present invention may have increased longevity as compared to other wear members. However, in another embodiment, the shape of the ceramic core 210 does not match the shape of the steel body.

In the present embodiment, the steel body 220 and the ceramic core 210 are triangularly shaped from a side view and are symmetric about a longitudinal axis 228 running through the center of the wear member 200 from the leading end 230 to the trailing end 240. In other embodiments, the steel body 220 and the ceramic core 210 may be triangularly shaped but may not be symmetric. For example, a ceramic core and steel body may be triangularly shaped with the lower core surface and the lower body surface being flat such that the side view looks like a right triangle. Moreover, in other embodiments the ceramic core 210 may not be triangularly shaped from a side view but may instead be truncated such that the ceramic core 210 is trapezoidal shaped from the side view. In other words, in the present embodiment, the front end 250 has a height that is about 0, but the disclosed invention may also include embodiments in which the height of the front end is greater than 0 but less than the height of the back end.

Figure 2D:
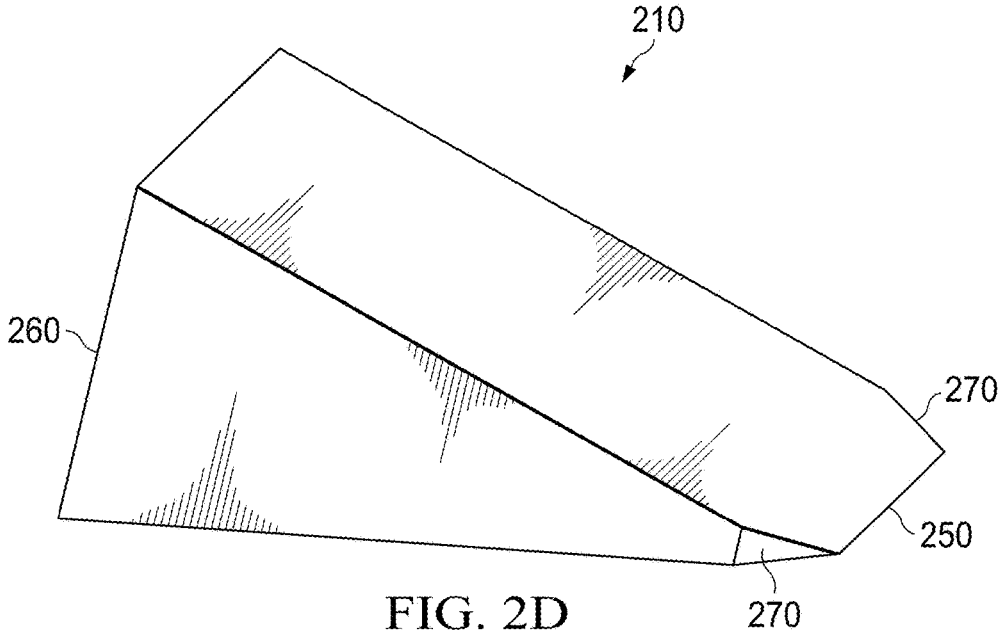
FIG. 2D is a perspective view of the ceramic core of the wear member shown in FIG. 2A.
Figure 3:
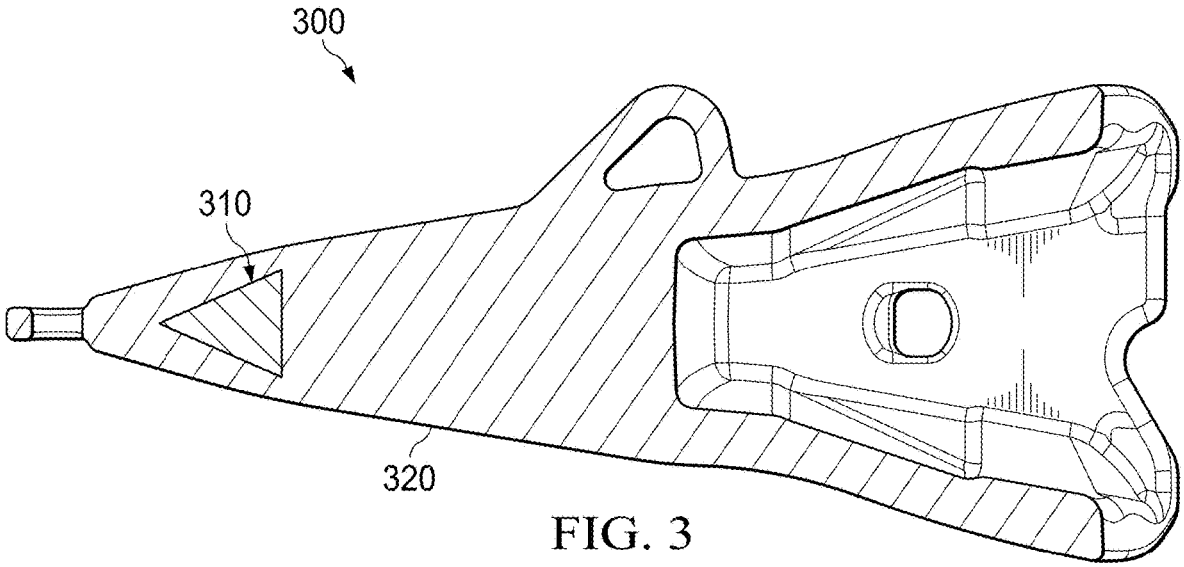
FIG. 3 is a side view of a wear member according to an example incorporating principles described herein.
Figure 4:
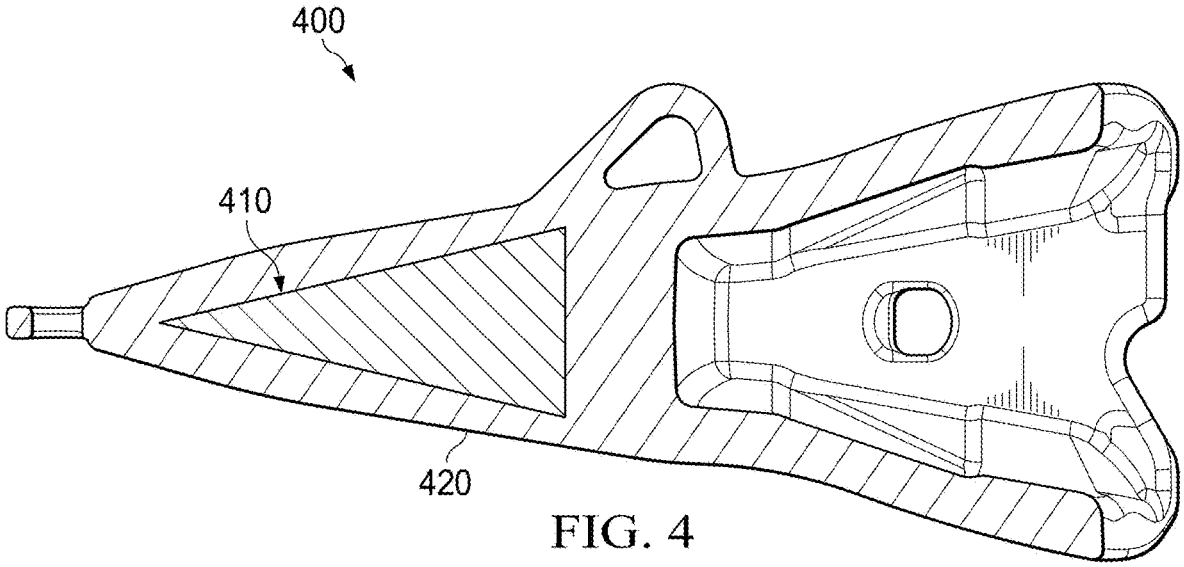
FIG. 4 is a side view of a wear member according to an example incorporating principles described herein.

FIG. 2D shows a perspective view of the ceramic core 210 shown in FIGS. 2A-2C. Various sizes of the ceramic core 210 shown in FIGS. 2A-2D are contemplated. FIGS. 3 and 4 show other embodiments of a wear member that are similar to the embodiment shown in FIGS. 2A-2D but contain a ceramic core that is a different size. In FIG. 3, the ceramic core 310 of the wear member 300 is the same shape as the ceramic core 210 shown in FIGS. 2A-2D. However, the present ceramic core 310 is smaller than the ceramic core 210 in FIGS. 2A-2D. Thus, the ratio of the steel (in the steel body 320) to ceramic (in the ceramic core 310) in the present embodiment is larger than the ratio of steel to ceramic in the wear member 200 in FIGS. 2A-2D.

Similarly, FIG. 4 shows another embodiment in which ceramic core 410 of the wear member 400 is the same shape as ceramic core 210 shown in FIG. 2C. However, the ceramic core 410 in the present embodiment is bigger than the ceramic core 210 in FIG. 2C. Thus, the ratio of the steel (in the steel body 420) to ceramic (in the ceramic core 410)

in FIG. 4 is smaller than the ratio of steel to ceramic of the wear member 200 in FIGS. 2A-2D.

Ceramic lends abrasive resistance to the wear member whereas steel lends impact resistance. Therefore, a wear member with a higher ratio of steel to ceramic may be able to withstand a higher impact than a wear member with a lower ratio of steel to ceramic. However, a wear member with a lower ratio of steel to ceramic may be better at withstanding abrasion. Thus, the desired ratio depends on the desired application.

Although the lengths of the ceramic cores in FIGS. 2A-2D, 3, and 4 are different, any dimension or a combination of dimensions can be smaller or larger, not just the length.

Figure 5A:
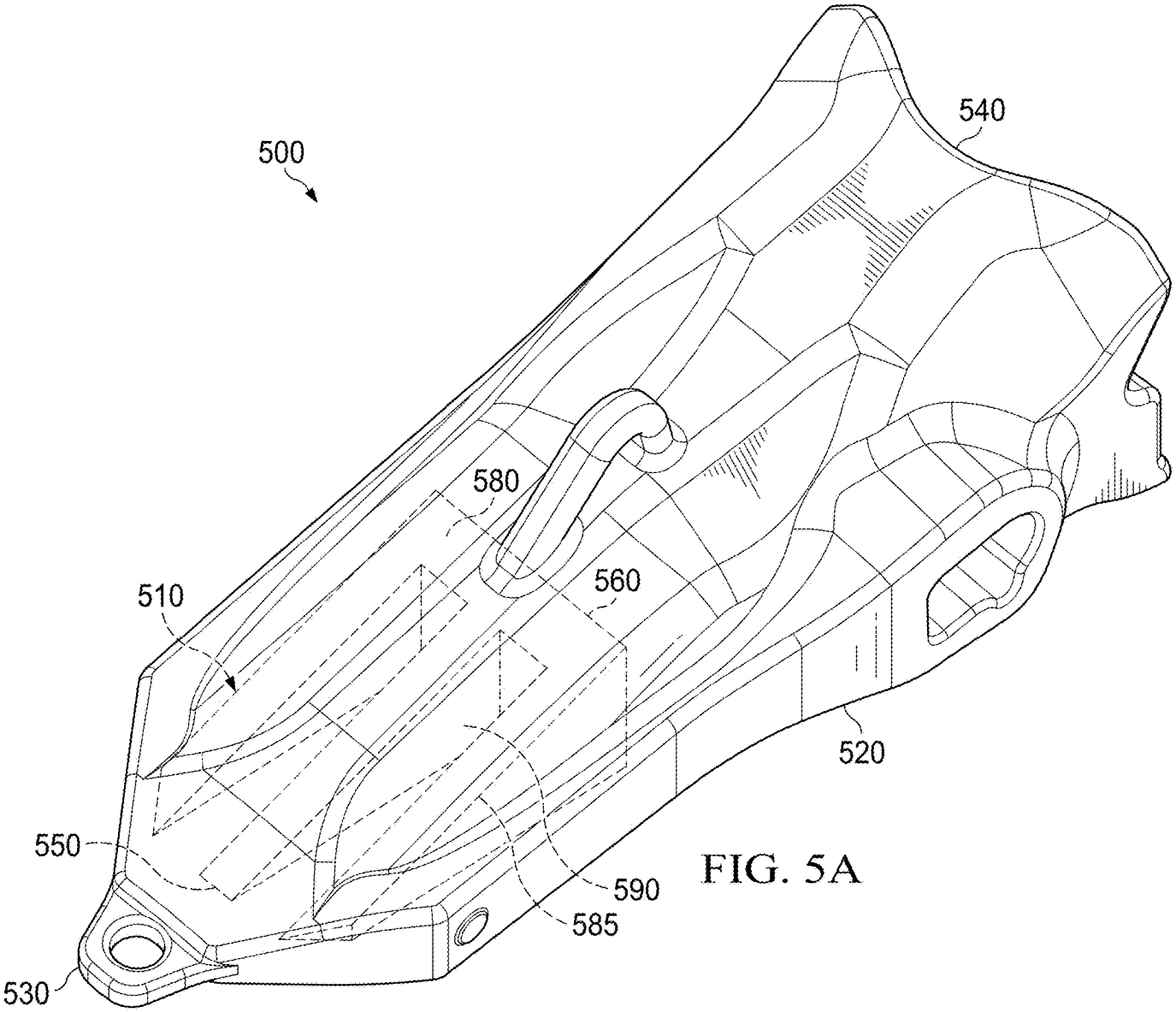
FIG. 5A is a perspective view of a wear member according to an example incorporating principles described herein.
Figure 5B:
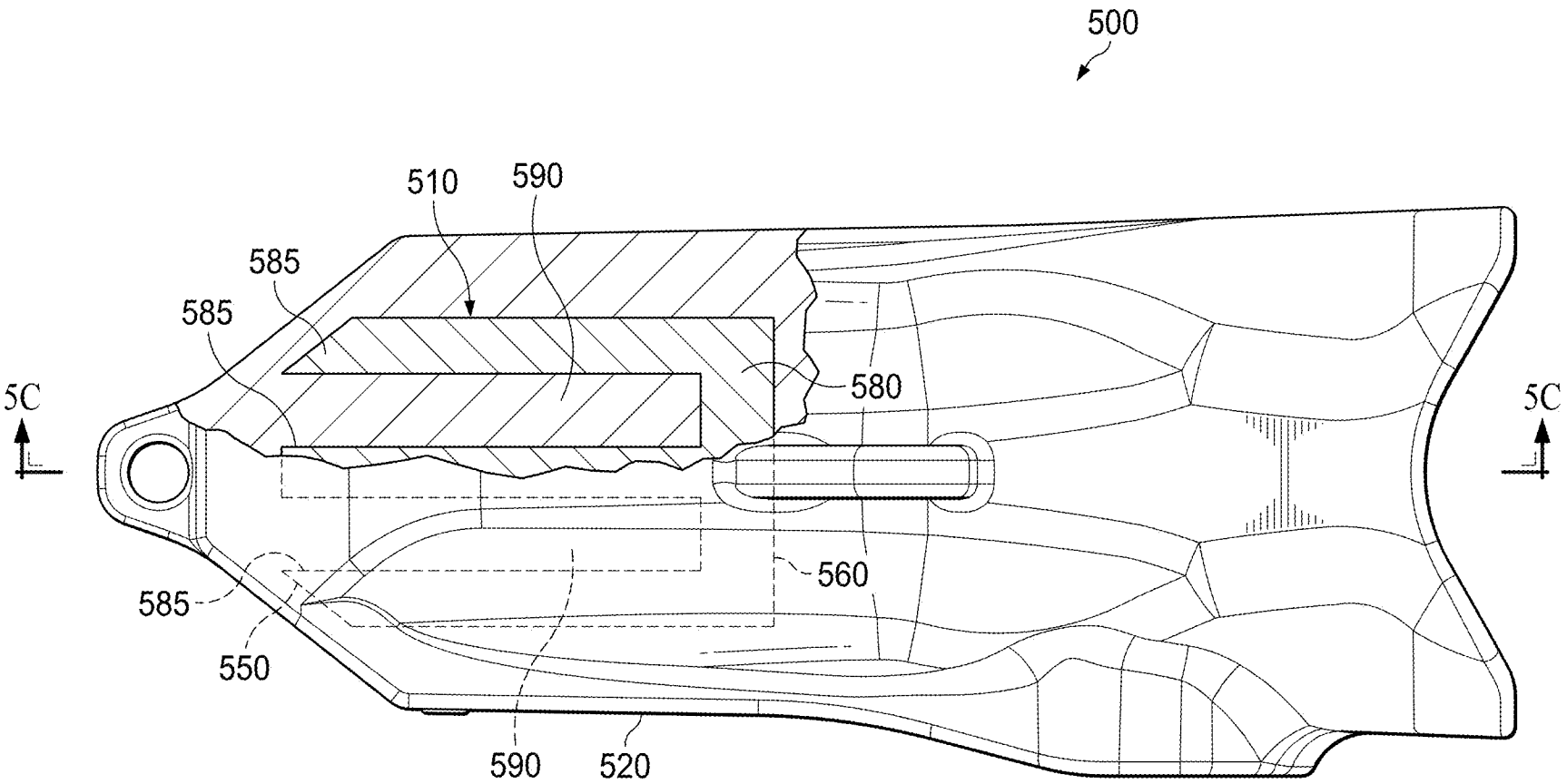
FIG. 5B is a partial cut away top view of the wear member shown in FIG. 5A.

FIGS. 5A-5D illustrate another embodiment of a wear member. FIG. 5A shows a perspective view of the wear member 500. FIG. 5B illustrates a top view of the wear member 500. The wear member 500 has a leading end 530 and a trailing end 540. The wear member 500 includes a ceramic core 510 (shown in dashed lines in FIG. 5A) and a steel body 520 that surrounds the ceramic core 510. The steel body 520 and the ceramic core 510 are wedge-shaped. The ceramic core 510 has a front end 550 and an opposing back end 560. The ceramic core 510 is positioned towards the leading end 530 of the steel body 520 such that the front end 550 is proximate to the leading end 530 of the steel body 520. Unlike the embodiments described in FIGS. 2A-D, 3, and 4, the ceramic core 510 in this embodiment has a mainstay 580 along the back end 560 with girders 585 extending from the mainstay 580 towards the front end 550. There are spaces 590 between the girders 585. The girders 585 and spaces 590 run generally parallel to each other between the front end 550 and the back end 560. However, in other embodiments, the girders 585 and the spaces 590 may not run parallel. Moreover, the side surfaces of the girders 585 are parallel in this embodiment. However, in other embodiments, the side surfaces of the girders 585 may not run parallel. That is, the girders or side surface may angle toward a longitudinal axis 528 in the direction of the leading end or trailing end. In the present embodiment, the mainstay 580 does not have any spaces or openings. In other embodiments, there may be spaces or openings in the mainstay 580. Additionally, the present embodiment contains three girders 585 and two spaces 590. However, in other embodiments there are more or fewer girders 585 and spaces 590. For example, in one embodiment, the ceramic core 510 has two girders 585 and one space 590. In another example, the ceramic core 510 has four girders 585 and three spaces 590.

Figure 5C:
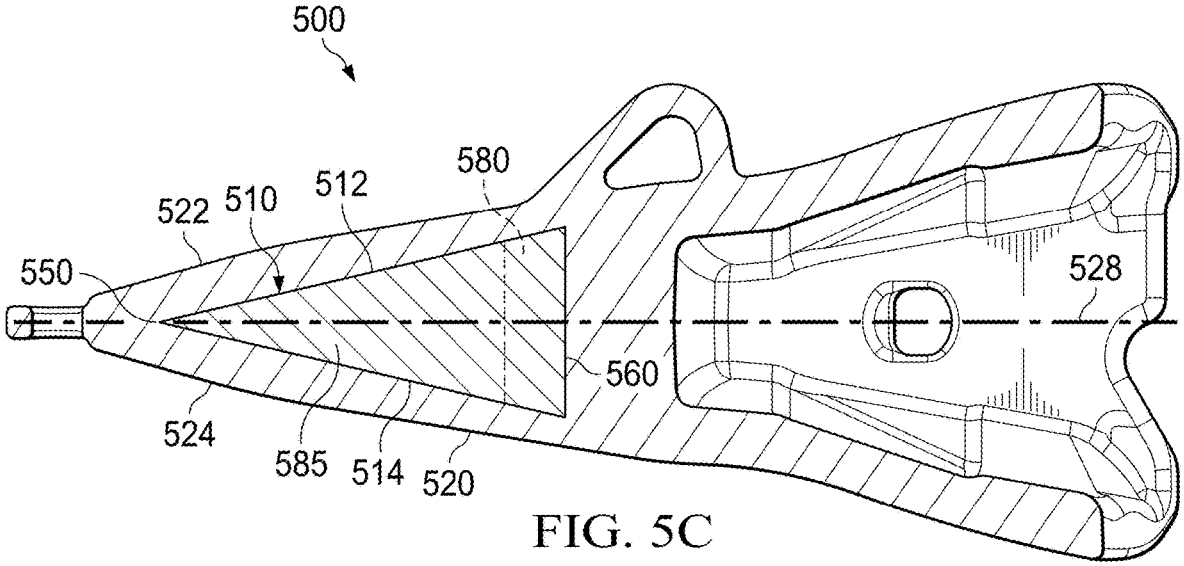
FIG. 5C is a side view of the wear member shown in FIG. 5A.

FIG. 5C illustrates a side view of the wear member 500. Only one girder 585 can be seen from this view. In the present embodiment, the ceramic core 510 is monolithic. However, in other embodiments the ceramic core 510 is not monolithic, but is comprised of more than one piece. The steel body 520 has an upper body surface 522 and an opposing lower body surface 524. The ceramic core 510 has an upper core surface 512 and an opposing lower core surface 514. The ceramic core 510 is shaped such that the upper core surface 512 and the lower core surface 514 generally follow the trend of the upper body surface 522 and the lower body surface 524, respectively. For example, in the present embodiment, the ceramic core 510 is shaped such that the upper core surface 512 is generally aligned with the upper body surface 522 and the lower core surface 514 is generally aligned with the lower body surface 524 when placed within the steel body 520. In some embodiments, the angle between the core surfaces 212, 214 and the body surfaces 222, 224 may diverge by an angle of about 0 to 8 degrees. Therefore, the wedge shape of the ceramic core 510 matches the wedge shape of the steel body 520. In other embodiments, the shape of the ceramic core 510 does not match the shape of the steel body 520.

In the present embodiment, the steel body 520 and the ceramic core 510 are triangularly shaped from a side view and are symmetric about a longitudinal axis 528 running through the center of the wear member 500 from the leading end 530 to the trailing end 540. However, in other embodiments the steel body 520 and the ceramic core 510 are triangularly shaped but not symmetric. For example, a ceramic core and steel body may be triangularly shaped with the lower core surface and the lower body surface being flat such that the side view looks like a right triangle. Moreover, in other embodiments, the ceramic core 510 is not triangularly shaped, but may instead be truncated such that the ceramic core 510 is trapezoidal shaped from the side view. In other words, in the present embodiment, the front end 550 has a height that is about 0, but the invention may also include embodiments in which the height of the front end is greater than 0 but less than the height of the back end 560.

Figure 5D:
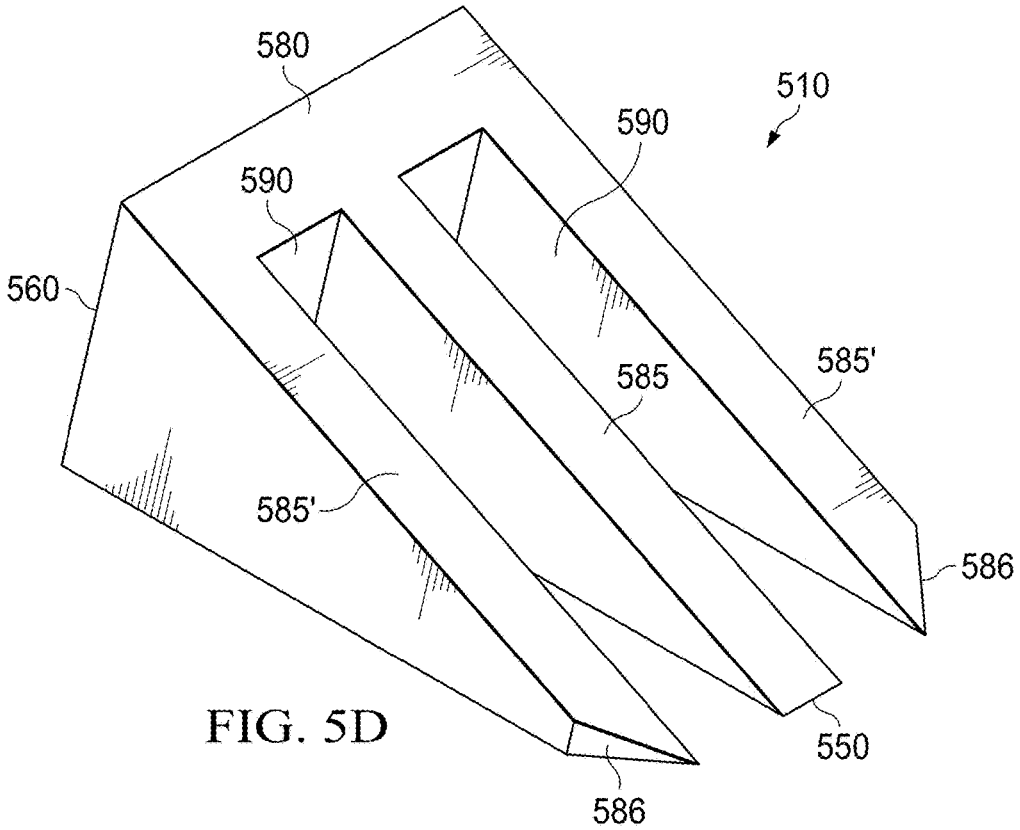
FIG. 5D is a perspective view of the ceramic core of the wear member shown in FIG. 5A.

FIG. 5D shows a perspective view of the ceramic core 510 shown in FIGS. 5A-5C. In this embodiment, the girders 585 are almost identical, with the tips 586 of the girders 585' along the sides of the ceramic core 510 are angled towards the center of the ceramic core 510. However, in other embodiments, all of the girders have tips 586 substantially parallel to the front end 550. In yet other embodiments, the girders 585 may come to a tip at the front end 550. Moreover, in other embodiments, the girders 585 are not nearly identical as shown in FIGS. 5A-5D.

Because the ceramic core 510 has spaces 590, the wear member 500 has a larger ratio of steel to ceramic. Therefore, this embodiment may be better suited to withstand higher impacts than the previous embodiments.

Figure 6A:
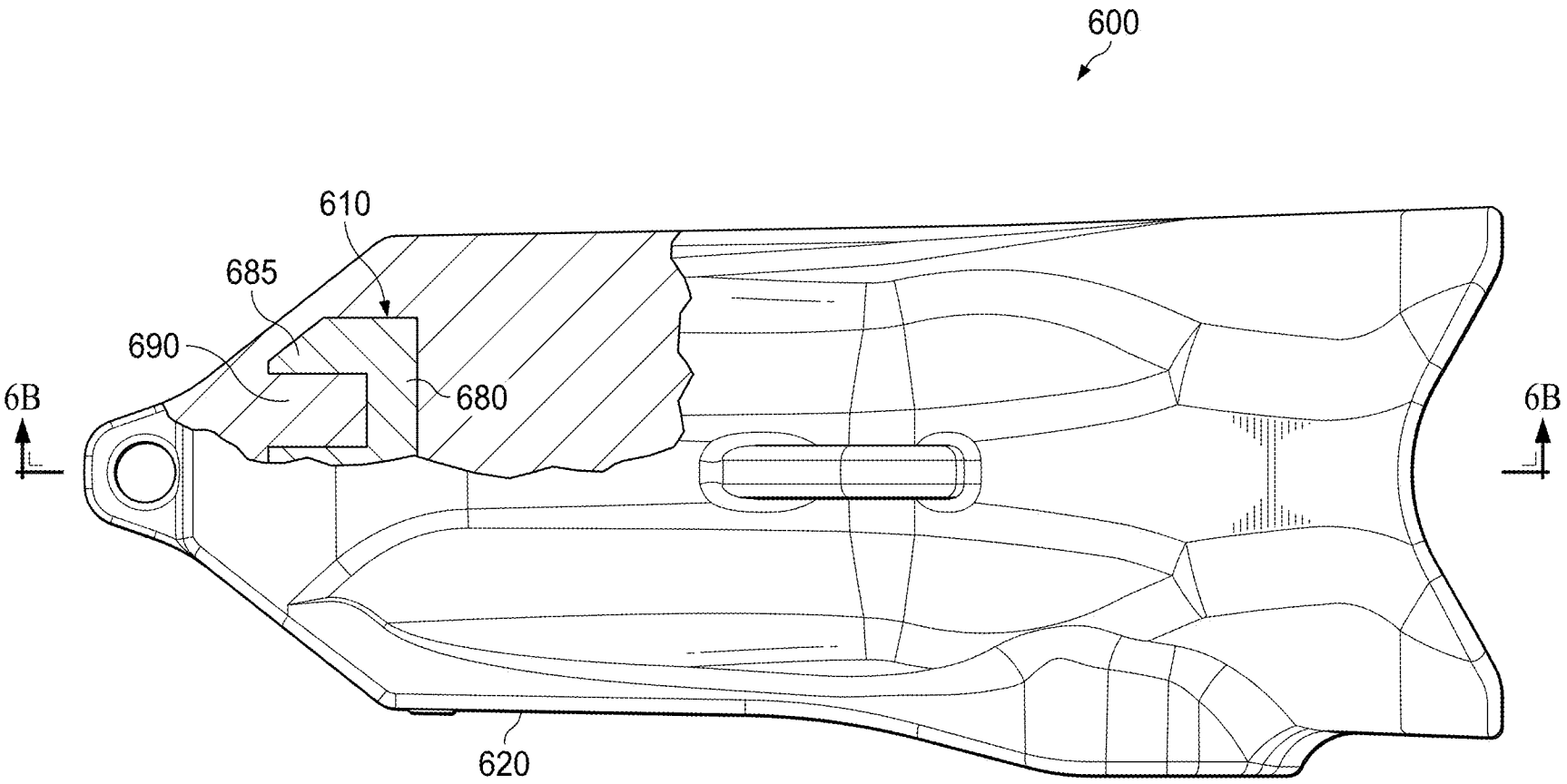
FIG. 6A is a partial cut away top view of a wear member according to an example incorporating principles described herein.
Figure 6B:
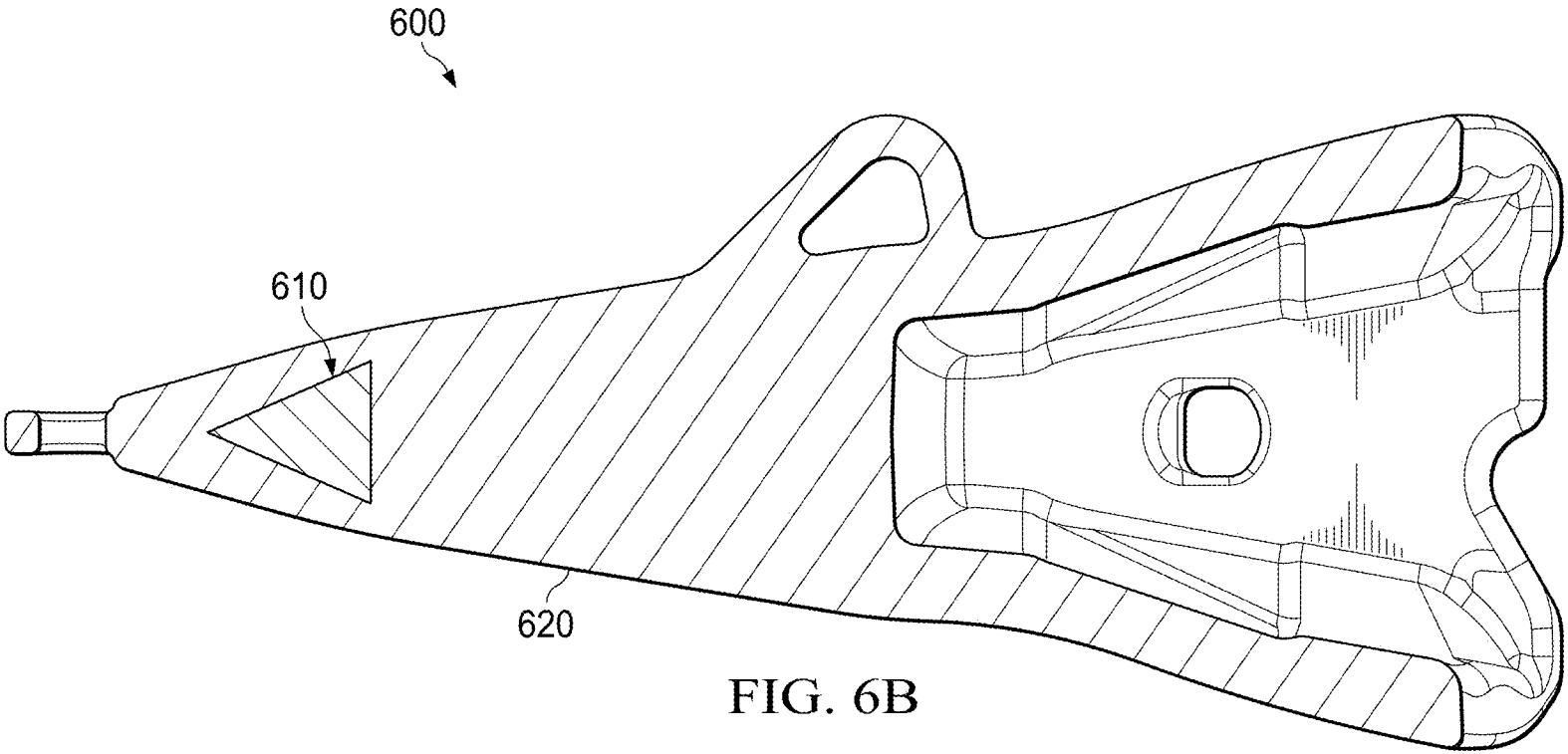
FIG. 6B is a side view of the wear member shown in FIG. 6A.

The ceramic core 510 shown in FIGS. 5A-5D may be various sizes. FIGS. 6A-6B show another embodiment of a wear member that is similar to the embodiment shown in FIGS. 5A-5D, but the ceramic core 610 is smaller. FIG. 6A shows a top view of a wear member 600 with a ceramic core 610. FIG. 6B shows a side view of the wear member 600. The ceramic core 610 of the present embodiment is the same shape as the ceramic core 510 in FIGS. 5A-5D. However, the length of the girders 685 of the ceramic core 610 in the present embodiment are shorter than the length of the girders 585 of the ceramic core 510 in FIGS. 5A-5D. Because the ceramic core 610 in the present embodiment is smaller than the ceramic core 510 in FIGS. 5A-5D, the ratio of the steel (in the steel body 620) to ceramic (in the ceramic core 610) is larger than the ratio of steel to ceramic of the wear member 500 in FIGS. 5A-5D. Therefore, the ceramic core 610 in FIGS. 6A-6B may be able to withstand a higher impact than the wear member 500 shown in FIGS. 5A-5D.

Although the embodiment in FIGS. 6A-6B has girders 685 with a shorter length, in other embodiments any dimension or combination of dimensions can be smaller or larger than the ceramic core 510 in FIGS. 5A-5D. For example, in some embodiments, a ceramic core according to the present disclosure is bigger than the ceramic core 510 in FIGS. 5A-5D.

Figure 7A:
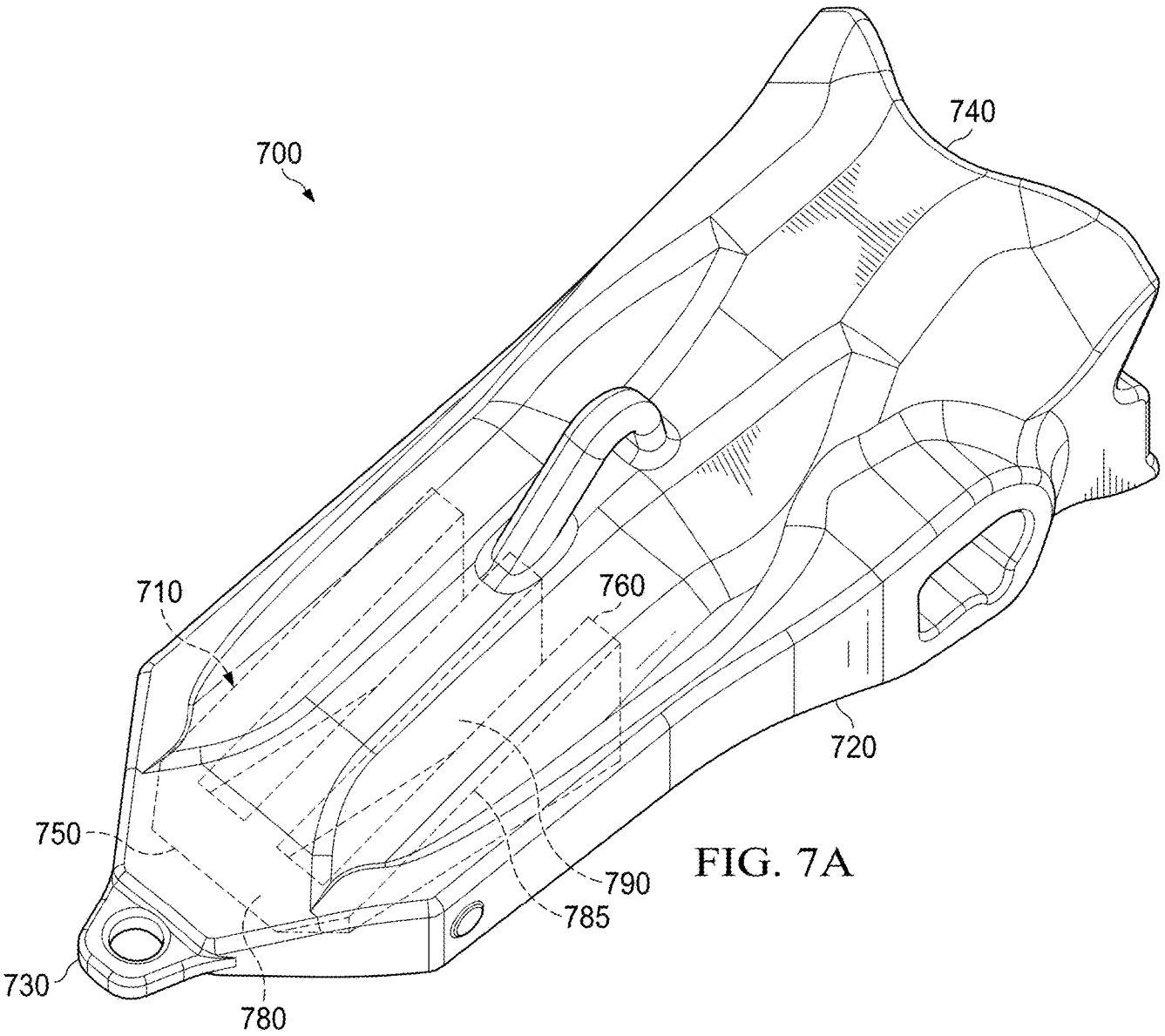
FIG. 7A is a perspective view of a wear member according to an example incorporating principles described herein.
Figure 7B:
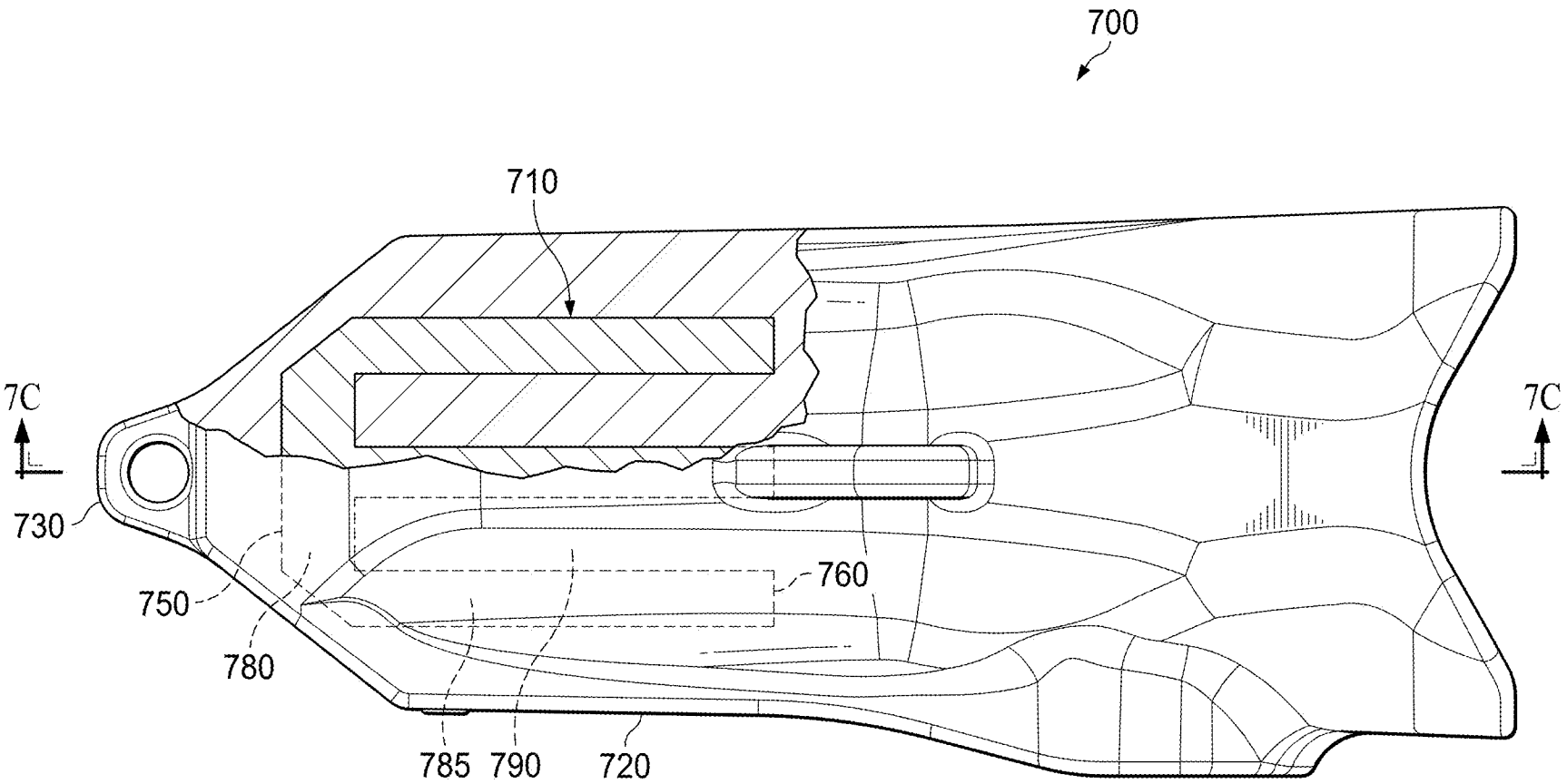
FIG. 7B is a partial cut away top view of the wear member shown in FIG. 7A.

FIGS. 7A-7D show another embodiment of a wear member according to the present disclosure. FIG. 7A shows a perspective view of the wear member 700. FIG. 7B illustrates a top view of the wear member 700. The wear member 700 has a leading end 730 and a trailing end 740. The wear member 700 includes a ceramic core 710 (shown in dashed lines in FIG. 7A) and a steel body 720 that surrounds the ceramic core 710. The steel body 720 and the ceramic core 710 are wedge-shaped. The ceramic core 710 has a front end 750 and a back end 760 located opposite the front end 750. The ceramic core 710 may be positioned towards the leading end 730 of the steel body 720 such that the front end 750 is proximate to the leading end 730 when the ceramic core 710 is disposed within the steel body 720. Unlike the embodiments described in FIGS. 5A-5D and FIGS. 6A-6B, the ceramic core 710 in the present embodiment has a mainstay 780 along the front end 750 with girders 785 extending from the mainstay 780 towards the back end 760. There are spaces 790 between the girders 785. The girders 785 and spaces 790 run generally parallel to each other between the front end 750 and the back end 760. However, in other embodiments, the girders 785 and the spaces 790 may not run parallel. Moreover, the side surfaces of the girders 785 are parallel in this embodiment. However, in other embodiments, the side surfaces of the girders 785 may not run parallel. In this embodiment, the mainstay 780 does not have spaces or openings. However, in other embodiments there are spaces or openings in the mainstay 780. The embodiment shown contains three girders 785 and two spaces 790. However, in other embodiments there are more or fewer girders 785 and spaces 790. For example, in one embodiment, the ceramic core 710 has two girders 785 and one space 790. In another example, the ceramic core 710 has four girders 785 and three spaces 790.

Figure 7C:
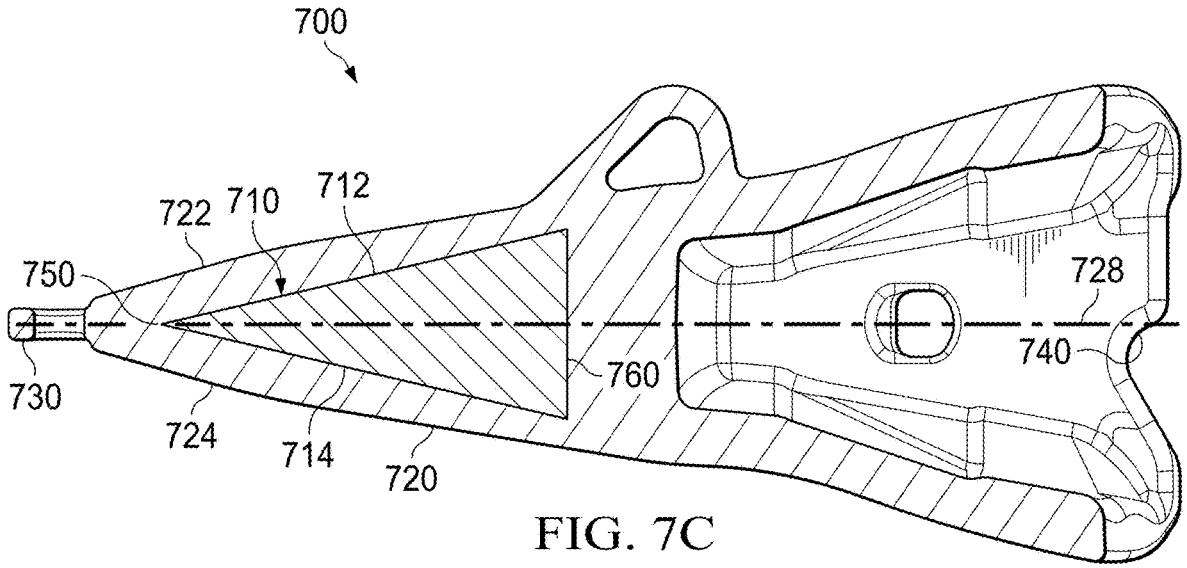
FIG. 7C is a side view of the wear member shown in FIG. 7A.

FIG. 7C illustrates a side view of the wear member 700. Only one girder 785 can be seen from this view. Moreover, in the present embodiment, the girders 785 and the mainstay 780 are monolithic. However, in other embodiments the ceramic core 710 may not be monolithic and may be comprised of more than one pieces. The steel body 720 has an upper body surface 722 and an opposing lower body surface 724. The ceramic core 710 has an upper core surface 712 and an opposing lower core surface 714. The ceramic core 710 is shaped such that the upper core surface 712 and the lower core surface 714 generally follow the trend of the upper body surface 722 and the lower body surface 724, respectively. For example, in the present embodiment, the ceramic core 710 is shaped such that the upper core surface 712 is generally aligned with the upper body surface 722 and the lower core surface 714 is generally aligned with the lower body surface 724 when disposed within the steel body 720. In some embodiments, the angle between the core surfaces 212, 214 and the body surfaces 222, 224 may diverge by an angle of about 0 to 8 degrees. Therefore, the wedge shape of the ceramic core 710 matches the wedge shape of the steel body 720. However, in other embodiments, the shape of the ceramic core 710 does not match the shape of the steel body 720.

From the side view, the steel body 720 and the ceramic core 710 are triangularly shaped and are symmetric about a longitudinal axis 728 running through the center of the wear member 700 from the leading end 730 to the trailing end 740. However, in other embodiments, the steel body and the ceramic core may be triangularly shaped but not be symmetric. For example, a ceramic core and steel body are triangularly shaped with the lower core surface and the lower body surface are flat such that the side view looks like a right triangle. Moreover, in other embodiments, the ceramic core may not be triangularly shaped from a side view, but may instead be truncated such that the ceramic core is trapezoidal shaped from the side view. In other words, in this embodiment, the front end 750 has a height that is about 0, but the invention may also include embodiments in which the height of the front end is greater than 0 and less than the height of the back end.

Figure 7D:
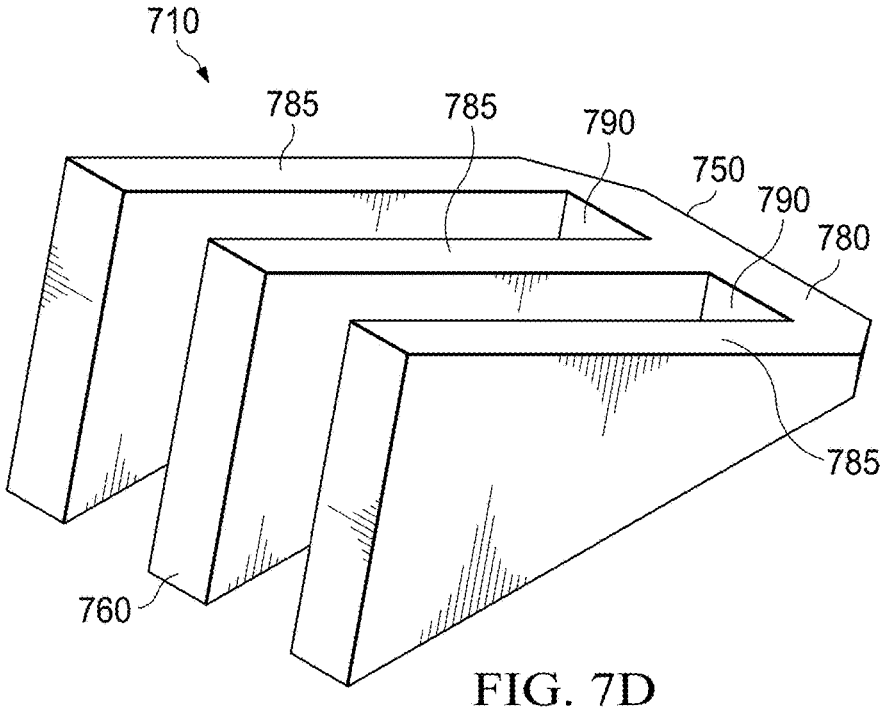
FIG. 7D is a perspective view of the ceramic core of the wear member shown in FIG. 7A.

FIG. 7D shows a perspective view of the ceramic core 710 shown in FIGS. 7A-7C. In this embodiment, the girders 785 have surfaces that are substantially parallel and have flat ends at the back end 760. However, in other embodiments, the girders 785 may come to a tip at the front end 750. In this embodiment, the girders 785 are identical. However, in other embodiments, the girders 785 may not be identical.

Figure 8A:
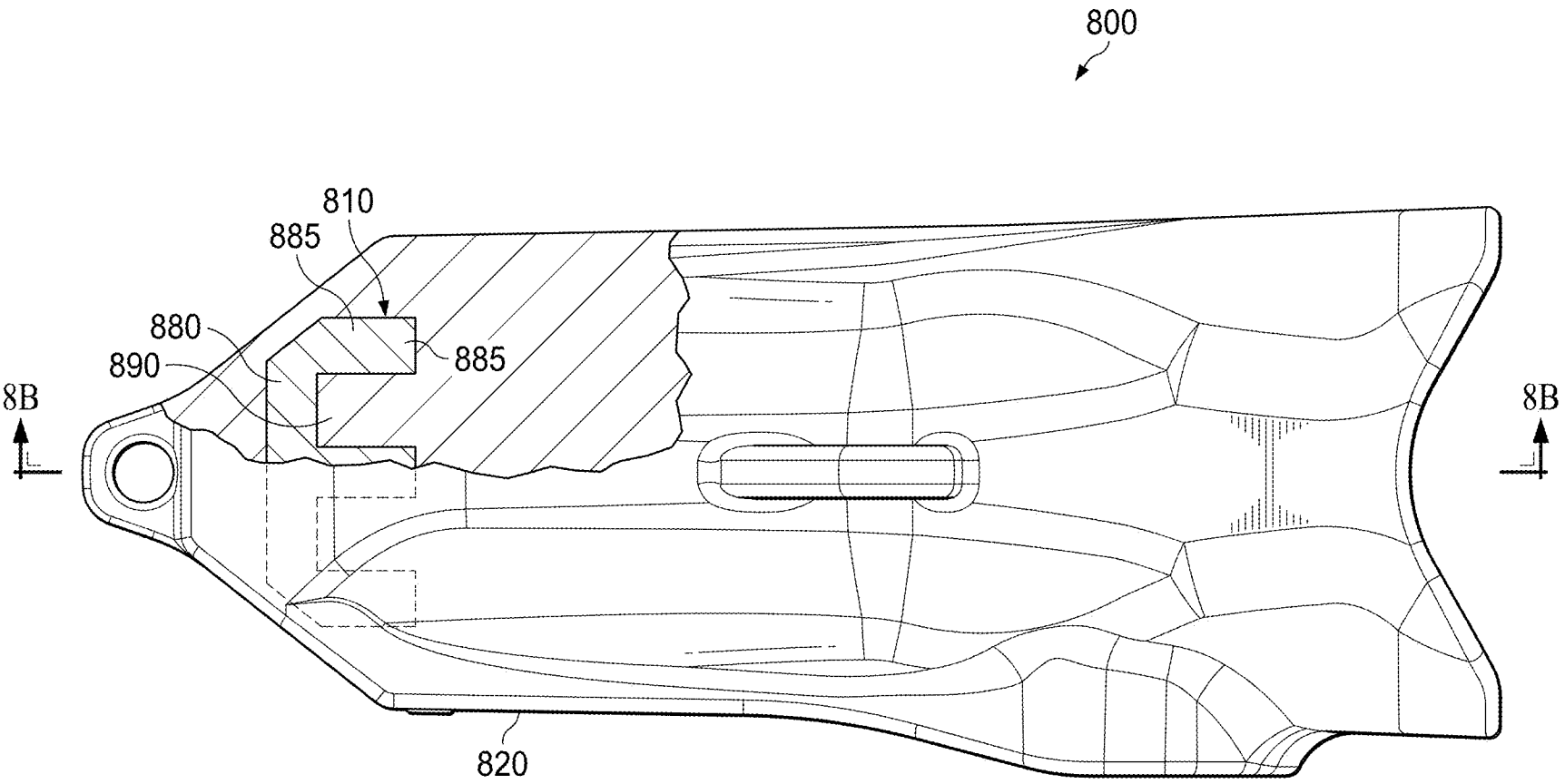
FIG. 8A is a partial cut away top view of a wear member according to an example incorporating principles described herein.
Figure 8B:
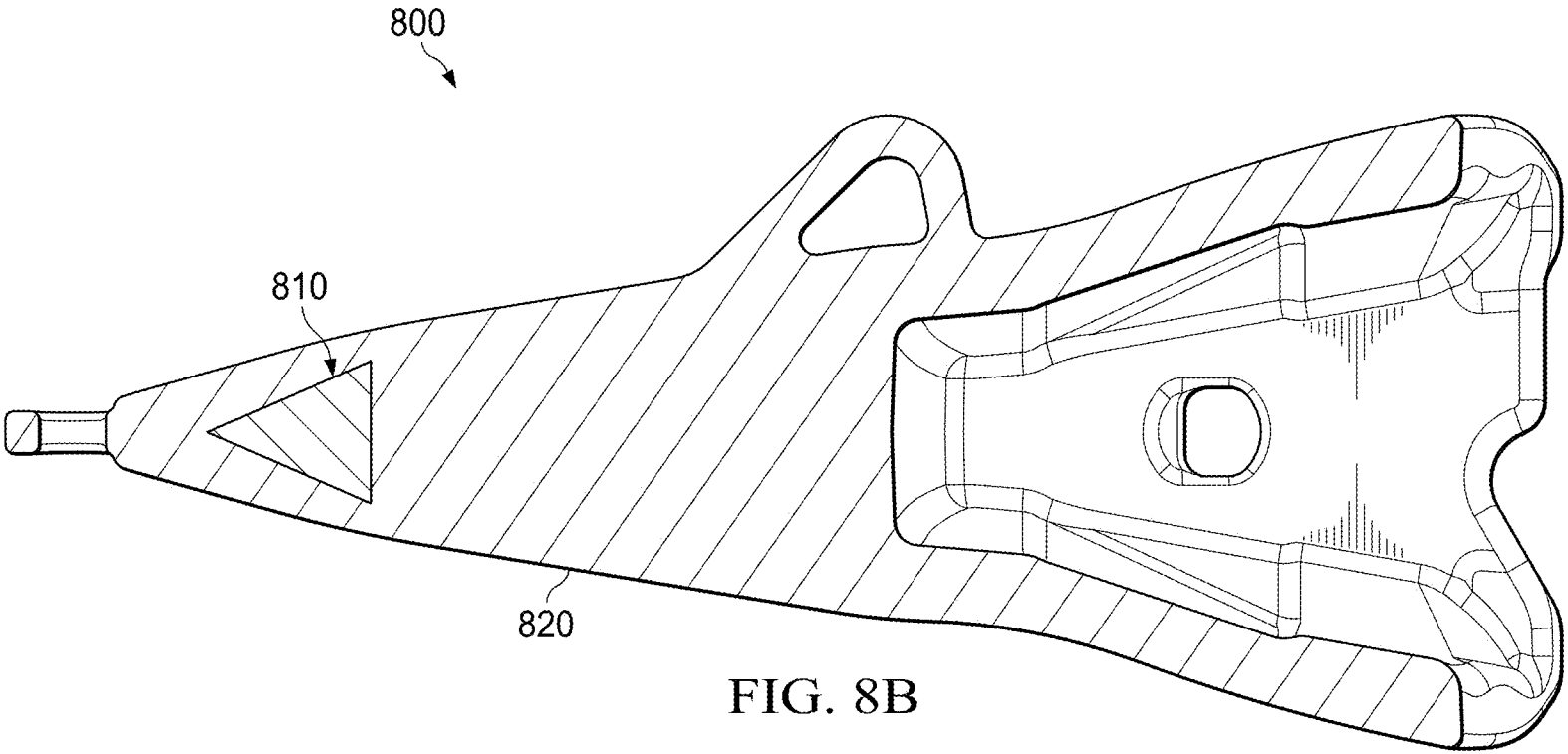
FIG. 8B is a side view of the wear member shown in FIG. 8A.

The ceramic core 710 shown in FIGS. 7A-7D can be various sizes. FIGS. 8A-8B show another embodiment of a wear member that is similar to the wear member 700 shown in FIGS. 7A-D, but the ceramic core 810 is smaller. FIG. 8A illustrates a top view of a wear member 800 with a ceramic core 810. FIG. 8B shows a side view of the wear member 800. The ceramic core 810 in the present embodiment is the same shape as the ceramic core 710 in FIGS. 7A-7D. However, the length of the girders 885 of the ceramic core 810 in the present embodiments are shorter than the length of the girders 785 of the ceramic core 710 in FIGS. 7A-7D. Because the ceramic core 810 is smaller than the ceramic core 710, the ratio of the steel (in the steel body 820) to ceramic (in the ceramic core 810) is larger than the ratio of steel to ceramic in FIGS. 7A-7D. Therefore, the ceramic core 810 in FIGS. 8A-8B may be able to withstand a higher impact than the wear member 700 shown in FIGS. 7A-7D. Although the present embodiment has girders 885 with a shorter length, any dimension or combination of dimensions can be smaller or larger the ceramic core 710 in FIGS. 7A-7D. For example, in one embodiment, the ceramic core is bigger than the ceramic core 710 in FIGS. 7A-7D.

Figure 9A:
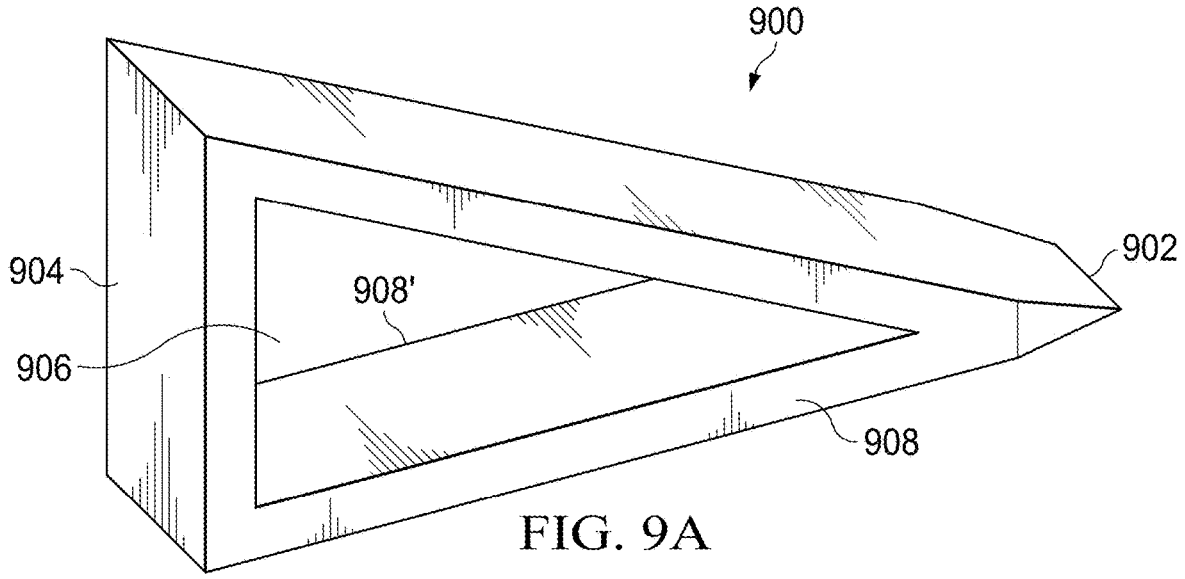
FIG. 9A is a perspective view of a ceramic core according to an example incorporating principles described herein.

FIGS. 9A-9H show different examples of ceramic cores according to the disclosed invention. FIG. 9A shows a wedged ceramic core 900 comparable to the embodiments shown in FIGS. 2A-2D, 3 and 4. The ceramic core 900 has a front end 902 and a back end 904, with the height at the back end 904 being greater than the height at the front end 902. In the present embodiment, the wedged ceramic core 900 comes to a point at the front end 902. In other embodiments, the wedge may be truncated. Unlike previous embodiments, ceramic core 900 has an aperture 906 passing through it from one side 908 to the other side 908'. In other embodiments, the aperture can be smaller or larger than the aperture 906 shown in the present embodiment. Moreover, it is possible that other embodiments of the invention could have openings through any of the surfaces of the ceramic core 900.

Figure 9B:
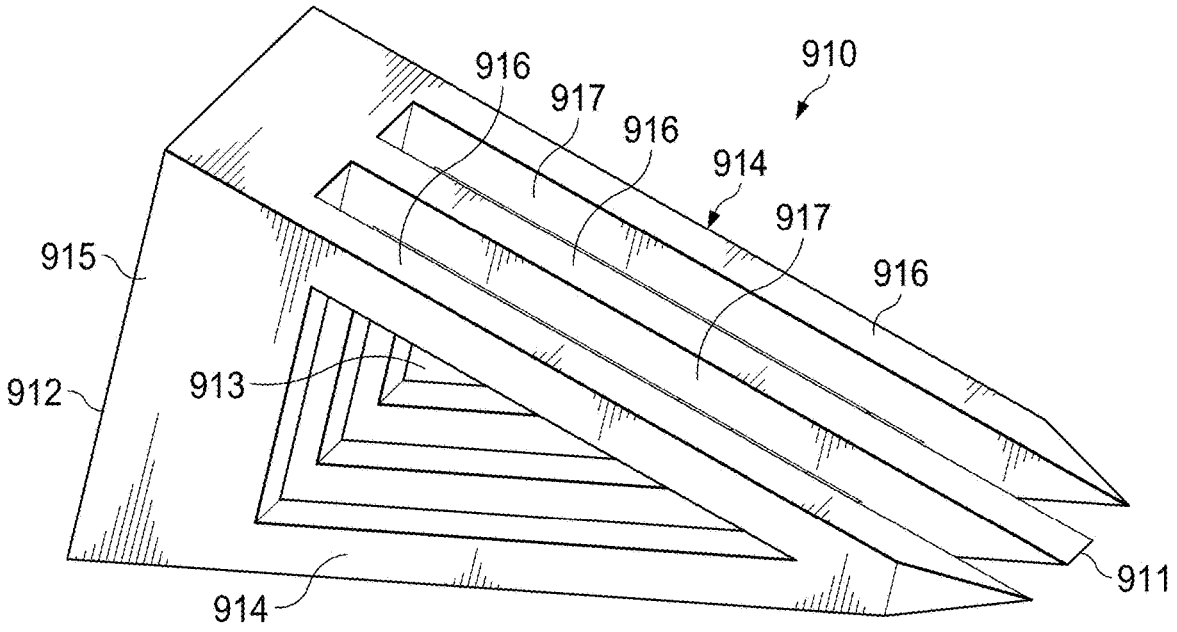
FIG. 9B is a perspective view of a ceramic core according to an example incorporating principles described herein.

FIG. 9B shows another embodiment of a ceramic core comparable to the embodiments in FIGS. 5A-5D and 6A-6B. The ceramic core 910 in FIG. 9B has a front end 911 and a back end 912. Ceramic core 910 is wedge-shaped with the back end 912 having a height greater than that of the front end 911. In this embodiment, the wedged ceramic core 910 comes to a point at the front end 911, but in other embodiments the wedge is truncated. The ceramic core 910 has a mainstay 915 at the back end 912 and girders 916 that extend from the mainstay 915 towards the front end 911. There are spaces 917 between the girders 916 that extend from the mainstay 915 towards the front end 911. In the present embodiment, the spaces 917 and girders 916 run substantially parallel to each other. However, in other embodiments the girders 916 and spaces 917 may not run substantially parallel from the mainstay 915. Moreover, in the present embodiment, ceramic core 910 has three girders 916 and two spaces 917. However, the ceramic core 910 may have fewer or more girders 916 and spaces 917. Unlike the ceramic core shown in FIGS. 5A-5D and 6A-6B, the ceramic core 910 shown in FIG. 9B has an aperture 913 that runs through the ceramic core 910 from one side 914 to the other side 914', extending through each girder 916. The aperture 913 can be any appropriate size.

Figure 9C:
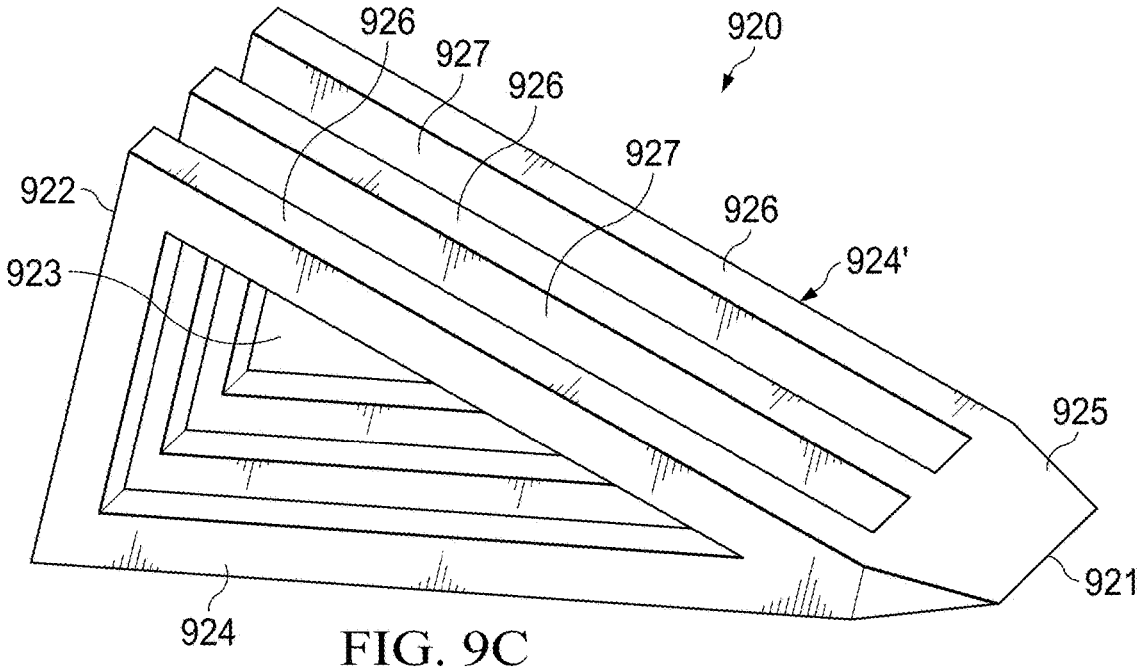
FIG. 9C is a perspective view of a ceramic core according to an example incorporating principles described herein.

FIG. 9C shows another embodiment of a ceramic core that is similar to the embodiments shown in FIGS. 7A-7D and 8A-8B. The ceramic core 920 shown in FIG. 9C has a front end 921 and a back end 922. The ceramic core 920 is wedge-shaped with the back end 922 having a height greater than that of the front end 921. In this embodiment, the wedged ceramic core 920 comes to a point at the front end 921, but it is contemplated that the wedge could be truncated. Ceramic core 920 has a mainstay 925 at the front end 921 and girders 926 that extend from the mainstay 925 towards the back end 922, with all of the girders 926 extending substantially parallel to each other. There are spaces 927 between the girders 926 that extend from the mainstay 925 towards the back end 922. In this embodiment the spaces 927 run substantially parallel to the girders 926. However, in other embodiments the spaces 927 and girders 926 may not run in parallel from the mainstay 925. In this embodiment, ceramic core 920 has three girders 926 and two spaces 927. However, in other embodiments the ceramic core 920 can have fewer or more girders 926 and spaces 927. Unlike the ceramic core in FIGS. 7A-7D and 8A-8B, the ceramic core 920 shown in this embodiment has an aperture 923 that runs through the ceramic core 920 from one side 924 to the other side 924', extending through each girder 926. In other embodiments, the aperture 923 can be any appropriate size.

Figure 9D:
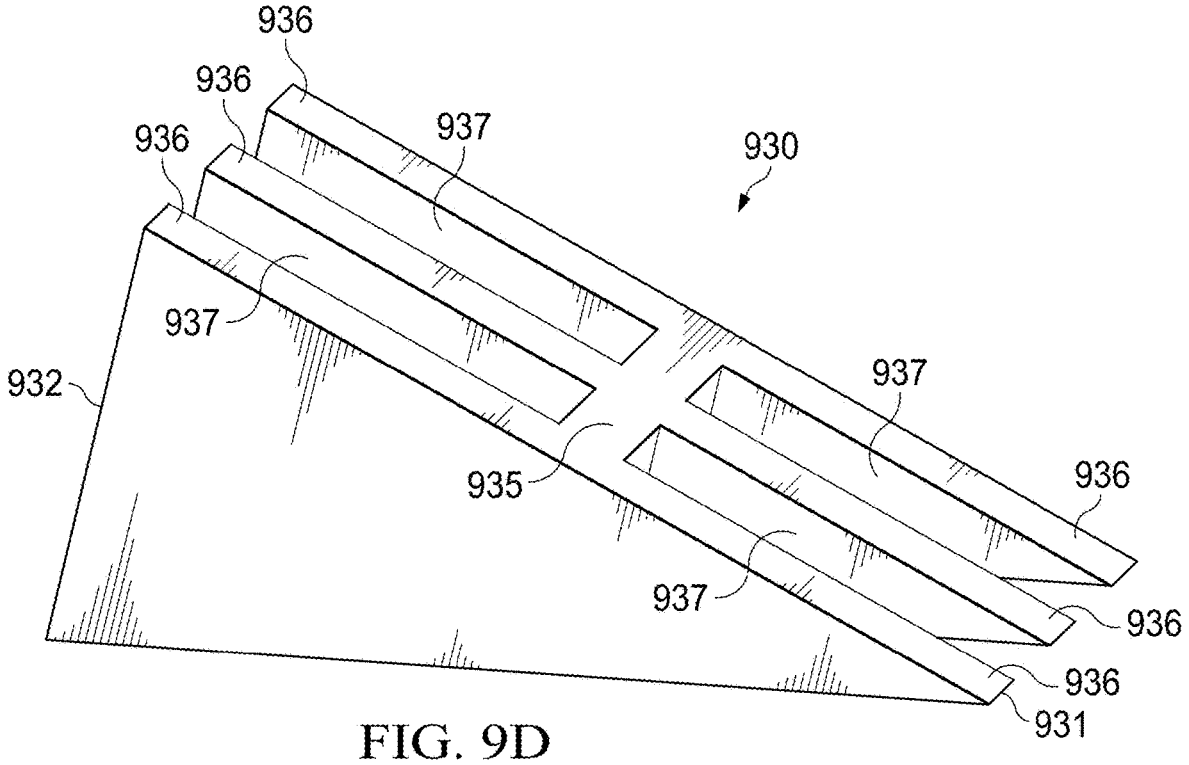
FIG. 9D is a perspective view of a ceramic core according to an example incorporating principles described herein.

FIG. 9D shows another embodiment of a ceramic core according to the present disclosure. The ceramic core 930 shown in FIG. 9D has a front end 931 and a back end 932. The ceramic core 930 is wedge-shaped in that the back end 932 has a height greater than that of the front end 931. In this embodiment, the wedged ceramic core 930 comes to a point at the front end 931, but it is contemplated that the wedge could be truncated. In this embodiment, the ceramic core 930 has a mainstay 935 in the middle of the ceramic core 930 between the front end 931 and the back end 932. The mainstay 935 has girders 936 that extend from the mainstay towards the back end 932 and girders 936 that extend from the mainstay 935 towards the front end 931. In this example, the girders 936 that extend towards the back end 932 and the girders 936 that extend towards the front end 931 are aligned. The girders 936 that extend towards the back end 932 are substantially parallel. The girders 936 that extend towards the front end 931 are substantially parallel. The ceramic core 930 has spaces 937 that run between the girder 936. In this embodiment the spaces 937 run substantially parallel to the girders 936. However, in other embodiments the spaces 937 and girders 936 may not run in parallel from the mainstay 935. In this embodiment, ceramic core 930 has three girders 936 and two spaces 937 that extend from the mainstay 935 to the back end 932 and has three girders 936 and two spaces 937 that extend from the mainstay 935 to the front end 931. However, in other embodiments the ceramic core 930 can have fewer or more girders 936 and spaces 937. In some embodiments, the number of girders 936 and spaces 937 that extend from the mainstay 935 to the back end 932 may be more or less than the number of girders 936 and spaces 937 that extend from the mainstay 935 to the front end 931.

Figure 9E:
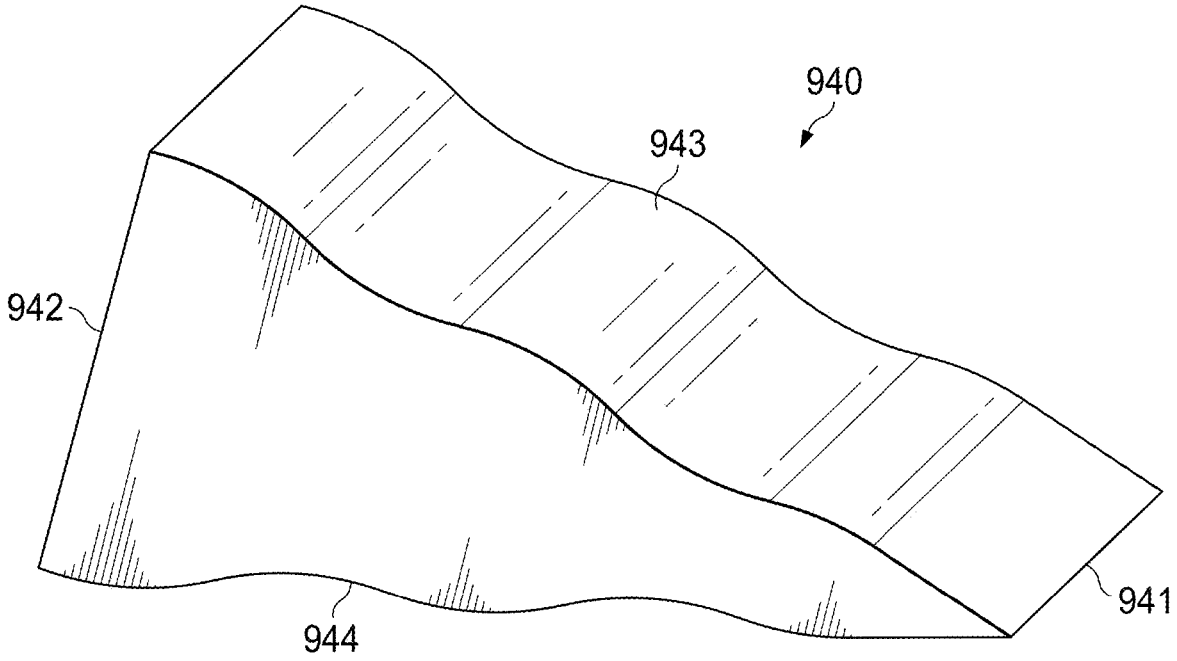
FIG. 9E is a perspective view of a ceramic core according to an example incorporating principles described herein.

FIG. 9E shows a ceramic core according to another embodiment of the present disclosure. The ceramic core 940 is wedge-shaped similarly to the ceramic core shown in FIGS. 2A-2D. In this embodiment, the ceramic core 940 has a front end 941 and a back end 942. The ceramic core 940 has an upper core surface 943 and a lower core surface 944. Unlike the ceramic core shown in FIGS. 2A-2D, the ceramic core 940 in this embodiment has a curved upper core surface 943 and a curved lower core surface 944. In this example, the upper core surface 943 and the lower core surface 944 have multiple curves, which make the surfaces have a wave-like shape. In other embodiments, the upper core surface 943 and the lower core surface 944 can have any number of curves. The curves may be convex or concave. Moreover, the curves can be at any degree of curvature and can change curvature. In other embodiments, any surface of the ceramic core 940 may be curved. In other embodiments, the upper core surface 943 and the lower core surface 944 can have any number of surface disruptions, such as steps, grooves, or other disruptions, with a general wedge-shape that has a back end height greater than a front end height.

Figure 9F:
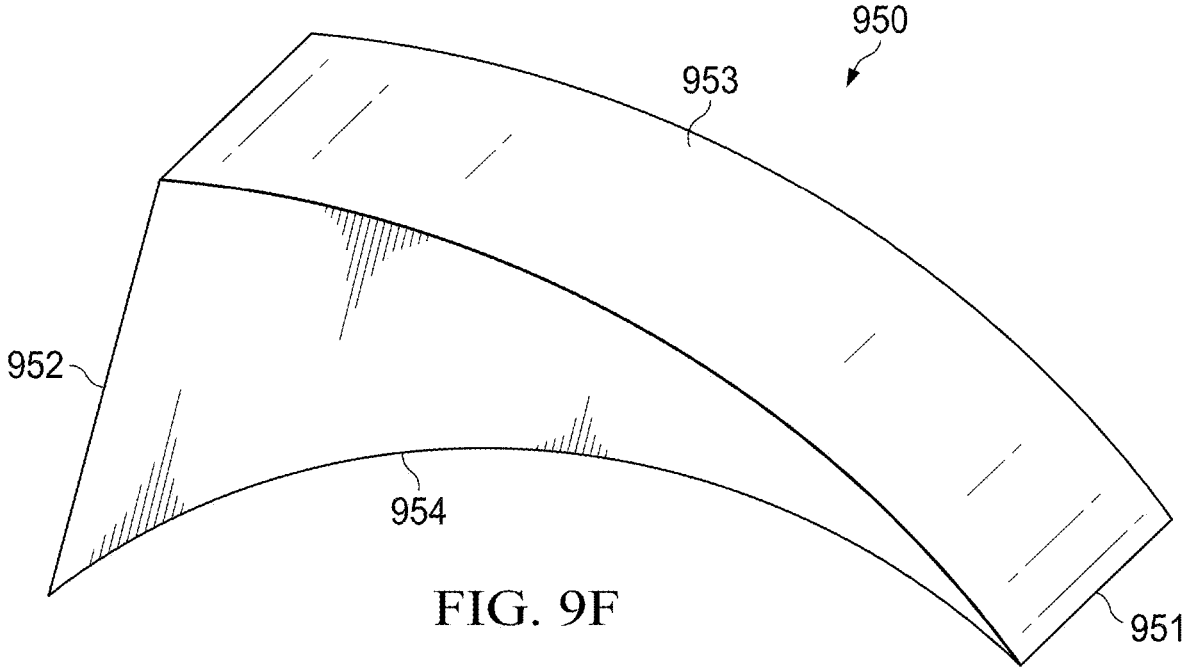
FIG. 9F is a perspective view of a ceramic core according to an example incorporating principles described herein.

FIG. 9F shows a ceramic core according to another embodiment of the present disclosure. In this embodiment, the ceramic core 950 has a front end 951 and a back end 952. The ceramic core 950 also has an upper core surface 953 and a lower core surface 954. In this embodiment, the upper core surface 953 and a lower core surface 954 are curved such that the ceramic core 950 is arched between the front end 951 and the back end 952. The curved upper core surface 953 and lower core surface 954 are generally aligned. However, in other embodiments, the upper core surface 953 and the lower core surface 954 may not be aligned. Moreover, in other embodiments, any surface of the ceramic core 950 may be arched. Consistent with some embodiments disclosed herein, the ceramic core 950 has a general shape that has back end height greater than a front end height.

Figure 9G:
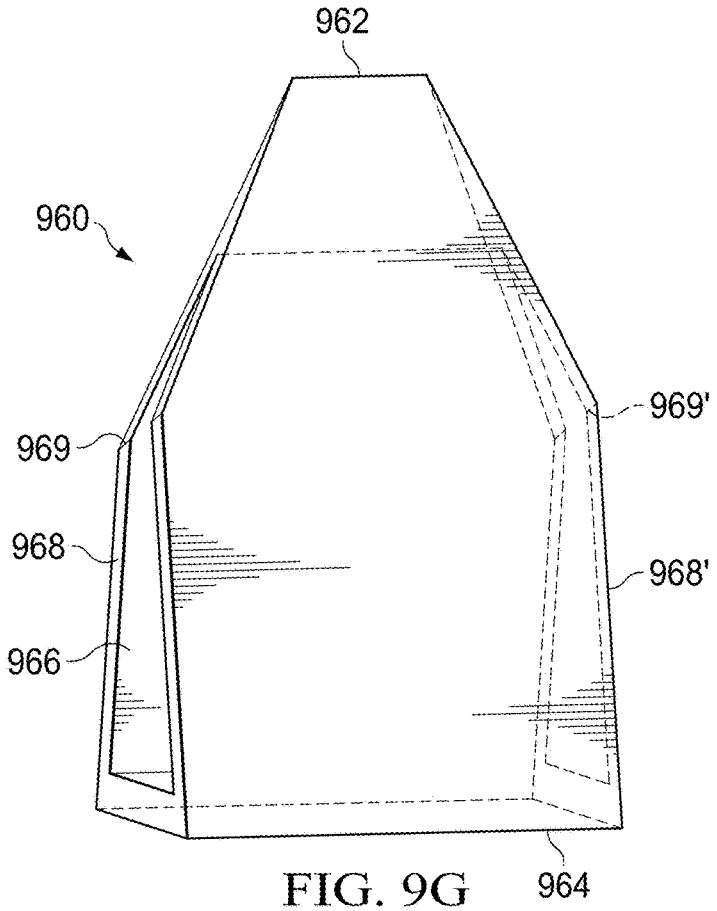
FIG. 9G is a perspective view of a ceramic core according to an example incorporating principles described herein.

FIG. 9G shows another embodiment of a ceramic core that is similar to the ceramic core 900 shown in FIG. 9A. FIG. 9G shows a wedged ceramic core 960. Ceramic core 960 has a front end 962 and a back end 964, with the height at the back end 964 being greater than the height at the front end 962. In this embodiment, the wedged ceramic core 960 comes to a point at the front end 962, but it is contemplated that the wedge could be truncated. Ceramic core 960 has an aperture 966 passing through it from one side 968 to the other side 968'. In other embodiments the aperture can be smaller or larger than the aperture 966 shown. However, unlike the ceramic core 900 in FIG. 9A, ceramic core 960 in FIG. 9G the sides 968, 968' do not run straight from the back end 964 to the front end 962. Instead, the sides 968, 968' run from the back end 964 straight towards midpoints 969, 969', but then angle inward more towards the center of the ceramic core 960 as the sides 968, 968' run from midpoints 969, 969' to the front end 962. In other embodiments, sides 968, 968' may run substantially parallel at first or at another angle from the back end 964 to the midpoints 969, 969'. The sides 968, 968' may run at any angle from midpoints 969, 969' to the front end 962. Midpoints 969, 969' may be located at any point between the front end 962 and back end 964. Moreover, in one embodiment, the sides 968, 968' run from the back end 964 and meet at a point at the front end 962.

Figure 9H:
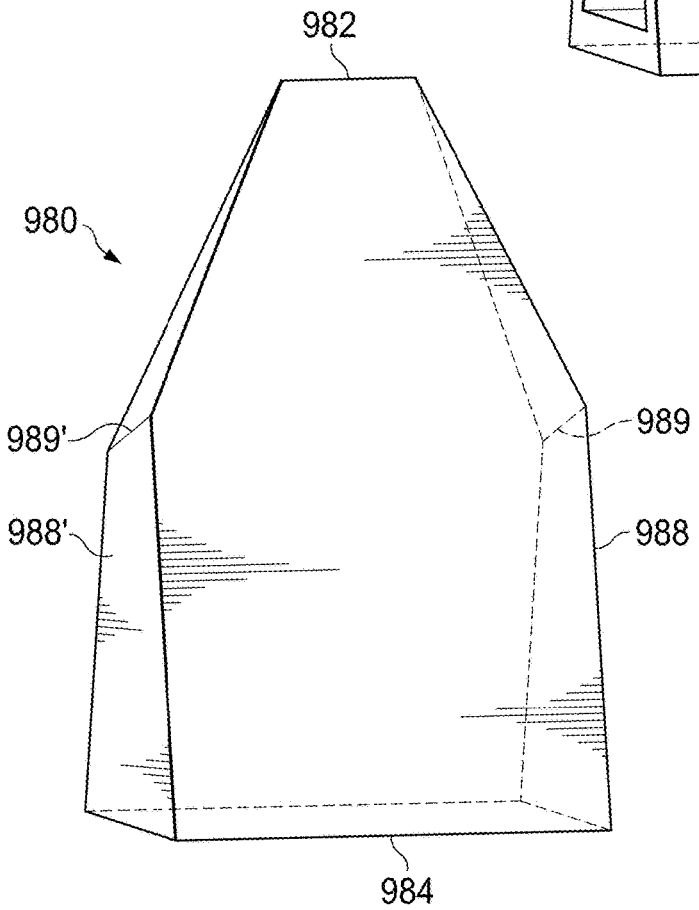
FIG. 9H is a perspective view of a ceramic core according to an example incorporating principles described herein.

FIG. 9H shows another embodiment of a ceramic core. This embodiment is the same as the embodiment in FIG. 9G except the ceramic core 980 in FIG. 9H does not have an aperture.

Figure 10:
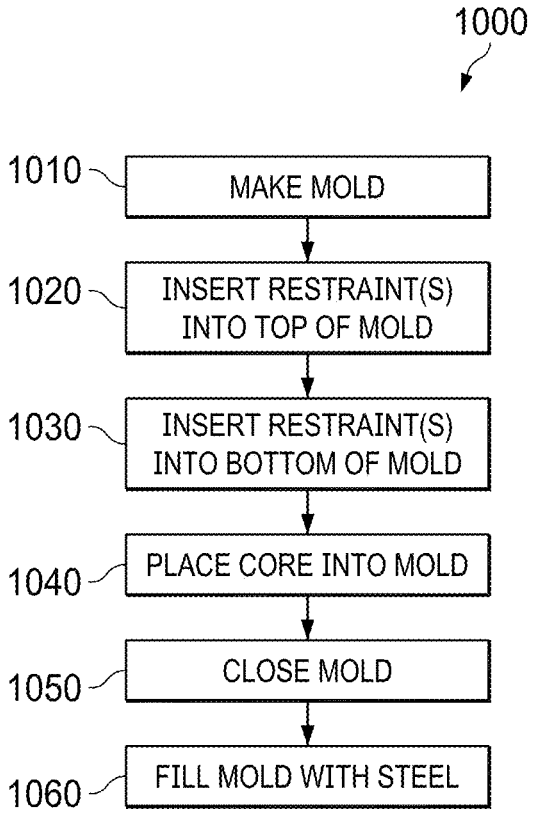
FIG. 10 is a flow chart of a method of manufacturing a wear member according to an example incorporating the principles described herein.

A wear member may be manufactured according to the method 1000 shown in FIG. 10. In some embodiments, the method 1000 may be used to manufacture a wear member assembly according to any embodiment of the present disclosure, including the embodiments discussed above. The method 1000 may include the process 1010 of making a mold. The mold may be in one or more parts. In some embodiments, the mold has a cavity that is in the shape of a wear member for use in excavating equipment. For example, the wear member may be any wear member described in the present disclosure, including a tooth, an adapter, or an intermediate adapter. The wear member may be shaped to fit over the nose of a support structure, including, for example, an adapter, an intermediate adapter, or a lip.

The method 1000 may include the process 1020 of inserting one or more restraints into the top of the mold. The method 1000 may also include the process 1030 of inserting one or more restraints into the bottom of the mold. The restraints may be nails or chaplets. In some embodiments, the restraints may be comprised of steel.

The method 1000 may include the process 1040 of placing the core into the mold. The core may be placed between the restraints such that the core is substantially fixed. In other embodiments, the core may be placed between the restraints such that the core can rise and/or fall. In some embodiments, the core can move laterally. In some embodiments, the core may be heated before being placed in the mold. In other embodiments, the core may be cooled before being placed in the mold. The core may be made of any appropriate material with a high abrasive resistance. For example, the core may be ceramic. Any core described in the present disclosure may be placed into the mold in process 1040. This includes any of the cores shown in FIGS. 2A through 9E.

However, in other embodiments, no restraints are inserted into the bottom of the mold. For example, one or more restraints are placed in the top of the mold to prevent the core from rising and touching the top of the mold. This may maintain the core in a desired location even if the core were to tend to float as molten metal is introduced into the mold. That is, the top restraints may prevent the core from floating to a location at the top of the mold unless desired. In other embodiments, no restraints are used on the top or bottom. For example, the restraint may pass through the core from the front end to the back end such that the restraint attaches to the sides of the mold. In another example, the restraint passes through the core from the bottom to the top. In this example, the restraint is the restraint is attached to the bottom of the mold and the top of the restraint is shaped to prevent the core from rising past a certain height when steel is added to the mold.

The method 1000 may include the process 1050 of closing the mold. The method 1000 may also include the process 1060 of filling the mold with steel. The steel may be heated such that the steel is liquid when added to the mold. The steel may surround all surfaces of the ceramic core and may impregnate the pores of the matrix making up the core. In some embodiments, the steel will cool such that the steel forms a body surrounding the core while at the same time being embedded within and throughout the porous matrix of the core. In one embodiment, the liquefied steel may melt the restraints such that they become integrated within the steel body. In some embodiments, the core may rise when the mold is filled with steel. The core may contact the restraints at the top of the mold.

Figure 11:
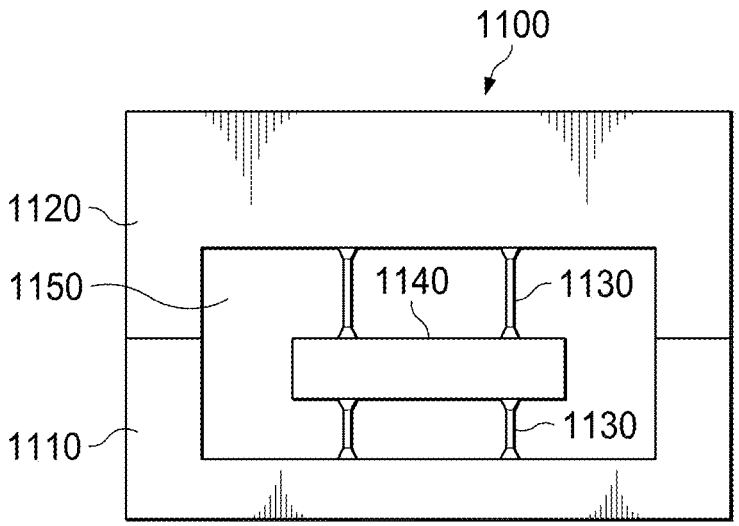
FIG. 11 is a diagram of a molding system after it has been closed according to the method shown in FIG. 10.

FIG. 11 shows an example diagram of the molding system after the mold is closed according to process 1050 in FIG. 10. In this embodiment, the bottom mold 1110 is secured to the top mold 1120. Restraints 1130 are shown contacting the core 1140. In this embodiment, there are two restraints 1130 supporting the core 1140 from the bottom and two restraints 1130 supporting the core 1140 from the top. However, any number of restraints 1130 may be used to position the core 1140. Additionally, the restraints 1130 are shown as being longer on the top of the core 1140 than on the bottom of the core 1140. However, in other embodiments the restraints may be any appropriate length for supporting the core 1140 and allowing steel to flow through the molding system 1100, including for example, all of the restraints being the same size or the restraints on the bottom being larger than the restraints on the top. Moreover, in other embodiments, restraints 1130 are placed along the sides of the core 1140, not just the top and bottom as shown in FIG. 11. The core 1140 may be any core described in the present disclosure, including for example, any core shown in FIGS. 2A-9H. Thus, even though FIG. 11 shows the core 1140 as being rectangular from a side view, the core 1140 may be wedge-shaped.

Figure 12:
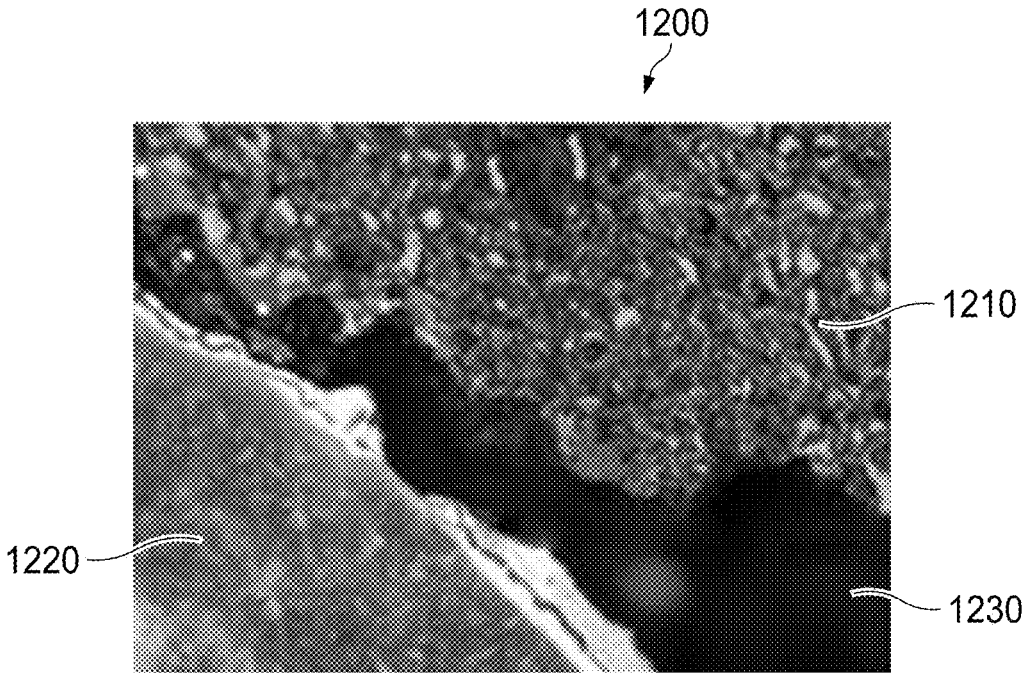
FIG. 12 is a magnified image of the interface between the steel body and the ceramic core according to an example incorporating the principles described herein.

FIG. 12 shows a magnified image of the interface between the ceramic core 1210 and steel body 1220 according to one embodiment of the present disclosure. As can be seen, the image includes both the ceramic core 1210 and the steel body 1220 surrounding and embedding about the fibrils of the porous ceramic matrix making up the ceramic core 1210. In this embodiment, the ceramic core 1210 is composed of silicon carbide. However, a ceramic core may be composed of any suitable ceramic including zirconia or a zirconia-based material (for example, zirconia-yttria, zirconia-magnesia, zirconia-calcia, or zirconia-alumina), a high alumina material (for example, white or tabular alumina), an aluminate (for example, aluminate spinel), an alumina-silicate (for example, mullite), or another ceramic carbide (for example, tungsten carbide or titanium carbide). In some embodiments, the ceramic core 1210 may be composed of one type of ceramic and may be coated in another material, including another ceramic. As the liquefied steel cools, the high specific heat and high thermal conductivity of the silicon carbide cause the steel to pull away from the ceramic core 1210. This forms an air gap 1230 between the steel body 1220 and the ceramic core 1210. The air gap 1230 prevents large cracks from forming through the wear member. If a crack forms in the steel body 1220 and moves through the body, it will be stopped by the air gap 1230. To crack the ceramic core 1210, more energy would be needed to start a new crack in the ceramic core 1210. This increases the longevity of the wear member by making it more difficult for large cracks to form.

For similar reasons, one embodiment of the invention uses a ceramic with various pore sizes to prevent cracking. When there are more pores of various sizes, it is difficult for large cracks to form. When a crack forms in the ceramic and reaches a pore, it will either continue cracking along the sides of the pore through the ceramic material or it will be stopped by the pore itself. When the crack forms around the pore, this increases the distance it must go to reach deeper into the ceramic core. When a crack stops at the pore, for the ceramic to continue cracking, more energy would be needed for a new crack to form along another side of the pore. Therefore, a ceramic with a higher volumetric porosity or with various pore sizes may increase the longevity of the ceramic core. For example, the ceramic in the present disclosure may have a volumetric porosity of between 45% and 95%; however, the volumetric porosity may be higher or lower than this range. In certain applications, the volumetric porosity may preferably be in the range of 70% to 90%.

Persons of ordinary skill in the art will appreciate that the implementations encompassed by the present disclosure are not limited to the particular exemplary implementations described above. In that regard, although illustrative implementations have been shown and described, a wide range of modification, change, combination, and substitution is contemplated in the foregoing disclosure. It is understood that such variations may be made to the foregoing without departing from the scope of the present disclosure. Accordingly, it is appropriate that the appended claims be construed broadly and in a manner consistent with the present disclosure.

What is claimed is:

1. A reinforced wear member comprising:
a body having:
a leading end;
a trailing end;
a top surface extending between the leading end and the trailing end; and
a bottom surface opposite the top surface and extending between the leading end and the trailing end;
wherein the body is formed of a first composition; and
a core embedded within the body, the core having:
a front end;
an opposing back end;
a top surface extending between the front end and the back end;
a bottom surface opposite the top surface that extends between the front end and the back end,
wherein a height of the front end is less than a height of the back end,
wherein the core is formed of a second composition,
wherein the first composition is different from the second composition, and
wherein the core is entirely embedded within the body such that the top surface of the core is spaced from the top surface of the body, the bottom surface of the core is spaced from the bottom surface of the body, and the front end of the core is spaced from the leading end of the body, wherein the core comprises a main stay and girders extending from the mainstay.

2. The wear member of claim 1, wherein the first composition is steel and the second composition is ceramic.

3. The wear member of claim 2, wherein the core comprises one or more of silicon carbide, zirconia-yttria, zirconia-magnesia, zirconia-calcia, zirconia-alumina, white alumina, tabular alumina, aluminate spinel, mullite, tungsten carbide or titanium carbide.

4. The wear member of claim 1, wherein the core is wedge-shaped.

5. The wear member of claim 4, wherein the front end is a point.

6. The wear member of claim 4, wherein
the top surface of the core aligns with the top surface of the body at an angle in a range of 0 degrees to 8 degrees and
the bottom surface of the core aligns with the bottom surface of the body at an angle in a range of 0 degrees to 8 degrees.

7. The wear member of claim 1, wherein the core is disposed adjacent the leading end.

8. The wear member of claim 1, wherein the core is disposed adjacent the trailing end.

9. The wear member of claim 1, wherein the mainstay is at the front end.

10. The wear member of claim 1, wherein the mainstay is at the back end.

11. The wear member of claim 1, wherein there are three girders.

12. The wear member of claim 1, wherein the core is monolithic.

13. The wear member of claim 1 wherein the core has a volumetric porosity ranging from 45% to 95%.

14. A reinforced wear member comprising:
a steel body having:
a body leading end;
a body trailing end;
a body upper surface extending between the body leading end and the body trailing end; and
a body lower surface opposite the body upper surface and extending between the body leading end and the body trailing end;
a wedge-shaped ceramic core embedded within the steel body, the ceramic core having:
a core leading end generally pointed toward the body leading end of the steel body;
a core upper surface; and
a core lower surface opposite the core upper surface,
wherein the core upper surface is spaced from the body upper surface, the core lower surface is spaced from the body lower surface, and the core leading end is spaced from the body leading end, wherein the core comprises a main stay and girders extending from the mainstay.

15. The wear member of claim 14, wherein the core is disposed along a longitudinal axis of the body.

16. The wear member of claim 14, wherein the upper core surface and the lower core surface are generally aligned with the body upper surface and the body lower surface, respectively.

17. The wear member of claim 14, wherein the upper core surface does not follow a trend of the upper body surface.

18. The wear member of claim 14, wherein the lower core surface does not follow a trend of the lower body surface.

19. The wear member of claim 14, wherein one or more surfaces of the core are curved.

20. A reinforced wear member comprising:
a body having:
a leading end;
a trailing end;
a top surface extending between the leading end and the trailing end; and
a bottom surface opposite the top surface and extending between the leading end and the trailing end;
wherein the body is formed of a first composition; and
a core embedded within the body, the core having:
a front end;
an opposing back end;
a top surface extending between the front end and the back end;
a bottom surface opposite the top surface that extends between the front end and the back end and follows a trend of the bottom surface of the body,
wherein a height of the front end is less than a height of the back end,
wherein the core is formed of a second composition,
wherein the first composition is different from the second composition, and
wherein the core is entirely embedded within the body such that the top surface of the core is spaced from and generally disposed at the same angle as the top surface of the body, the bottom surface of the core is spaced from and generally disposed at the same angle as the bottom surface of the body, and the front end of the core is spaced from the leading end of the body, wherein the core comprises a main stay and girders extending from the mainstay.

* * * * *